US012623121B1

(12) United States Patent
Raymond et al.

(10) Patent No.: US 12,623,121 B1
(45) Date of Patent: May 12, 2026

(54) GOLF BALL

(71) Applicant: Taylor Made Golf Company, Inc., Carlsbad, CA (US)

(72) Inventors: Ben Raymond, Carlsbad, CA (US); Dana Ehyaei, San Diego, CA (US); Todd P. Beach, Carlsbad, CA (US); David Anderson, Palatine, IL (US); Balachandra Reddy Mettu, Carlsbad, CA (US); Joshua Dipert, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 18/129,683

(22) Filed: Mar. 31, 2023

Related U.S. Application Data

(60) Provisional application No. 63/326,103, filed on Mar. 31, 2022, provisional application No. 63/391,105, filed on Jul. 21, 2022.

(51) Int. Cl.
*A63B 37/00* (2006.01)

(52) U.S. Cl.
CPC ..... *A63B 37/0078* (2013.01); *A63B 37/0041* (2013.01); *A63B 37/0061* (2013.01); *A63B 37/0065* (2013.01); *A63B 37/0084* (2013.01); *A63B 37/0087* (2013.01); *A63B 37/0074* (2013.01); *A63B 37/0075* (2013.01); *A63B 37/0076* (2013.01)

(58) Field of Classification Search
CPC ..... A63B 37/0003–0097
See application file for complete search history.

(56) References Cited

U.S. PATENT DOCUMENTS

| | | | | |
|---|---|---|---|---|
| 6,207,760 | B1 * | 3/2001 | Rajagopalan | C08L 23/26 525/196 |
| 6,290,611 | B1 * | 9/2001 | Rajagopalan | C08L 77/00 473/378 |
| 7,160,209 | B2 * | 1/2007 | Marotta | A63B 37/0003 473/378 |
| 7,182,703 | B2 * | 2/2007 | Emerson | A63B 37/06 473/378 |
| 9,962,577 | B1 * | 5/2018 | Chavan | A63B 37/0091 |
| 10,137,332 | B1 * | 11/2018 | Jeon | C09D 183/06 |
| 10,207,156 | B1 * | 2/2019 | Chavan | A63B 45/00 |
| 10,252,114 | B1 * | 4/2019 | Petrich | A63B 37/0043 |

(Continued)

OTHER PUBLICATIONS

USGA, and R&A, Actual Launch Conditions Overall Disttance and Symmetry Test Procedure, Feb. 28, 11, USGA, Rev. 2.0.0, 8 pages.*

(Continued)

*Primary Examiner* — Nicholas J. Weiss
*Assistant Examiner* — Matthew B Stanczak
(74) *Attorney, Agent, or Firm* — Klarquist Sparkman, LLP

(57) ABSTRACT

A golf ball having contact time, $CT_{143}$ of greater than or equal to about 400 microsecs, a Coefficient of Restitution, $COR_{143}$ of greater than or equal to about 0.720, an Initial Velocity (IV) of greater than or equal to about 255 ft/sec and a relative ratio, $RR_{80/127}$ or $RR_{80/125}$ or $RR_{80/123}$ each of greater than or equal to about 1.01, or a relative ratio, $RR_{90/127}$ or $RR_{90/125}$ or $RR_{90/123}$ each of greater than or equal to about 1.03.

9 Claims, 25 Drawing Sheets

(56) References Cited

U.S. PATENT DOCUMENTS

| | | | | |
|---|---|---|---|---|
| 10,252,117 | B1 * | 4/2019 | Simonds | B29C 43/18 |
| 10,376,744 | B1 * | 8/2019 | Petrich | A63B 37/0033 |
| 10,507,362 | B1 * | 12/2019 | Chavan | A63B 37/0087 |
| 10,709,937 | B1 * | 7/2020 | Jeon | A63B 37/0051 |
| 10,722,755 | B1 * | 7/2020 | Chavan | A63B 37/00222 |
| 10,870,039 | B1 * | 12/2020 | Jeon | A63B 45/00 |
| 11,185,743 | B1 * | 11/2021 | Chavan | A63B 45/00 |
| 11,560,462 | B1 * | 1/2023 | Castner | C08K 5/098 |
| 12,420,146 | B2 * | 9/2025 | Ehyaei | A63B 37/0006 |
| 2001/0046907 | A1 * | 11/2001 | Bartels | A63B 37/0003 473/370 |
| 2011/0092314 | A1 * | 4/2011 | Higuchi | A63B 37/0018 473/383 |
| 2011/0098132 | A1 * | 4/2011 | Higuchi | A63B 37/0017 473/383 |
| 2013/0210545 | A1 * | 8/2013 | Ishii | A63B 37/0003 473/374 |
| 2016/0326341 | A1 * | 11/2016 | Bulpett | C08L 23/0876 |
| 2017/0340925 | A1 * | 11/2017 | Sullivan | A63B 37/0003 |
| 2018/0256943 | A1 * | 9/2018 | Britton | A63B 37/0039 |
| 2019/0099642 | A1 * | 4/2019 | Brown | A63B 37/0045 |
| 2019/0118042 | A1 * | 4/2019 | Sullivan | A63B 37/0092 |
| 2020/0206579 | A1 * | 7/2020 | Sato | A63B 37/0087 |
| 2020/0215394 | A1 * | 7/2020 | Sullivan | A63B 37/0039 |
| 2022/0023721 | A1 * | 1/2022 | Melanson | A63B 37/0076 |
| 2022/0249915 | A1 * | 8/2022 | Sullivan | A63B 37/0043 |
| 2022/0280838 | A1 * | 9/2022 | Ehyaei | A63B 37/0039 |
| 2023/0148396 | A1 * | 5/2023 | Ehyaei | A63B 37/0021 473/378 |
| 2024/0100401 | A1 * | 3/2024 | Watanabe | A63B 37/0068 |
| 2025/0195958 | A1 * | 6/2025 | Raymond | A63B 37/0069 |

OTHER PUBLICATIONS

USGA, Overall Distance Standard and Symmetry Test Protocol, Apr. 9, 2019, USGA, , Rev. 3.0, 7 pages.*

* cited by examiner

Spin and Launch Angle vs Ballspeed

Total Distance vs Ball Speed

FIG. 2 - 0.72 COR ($RR_{123}$)
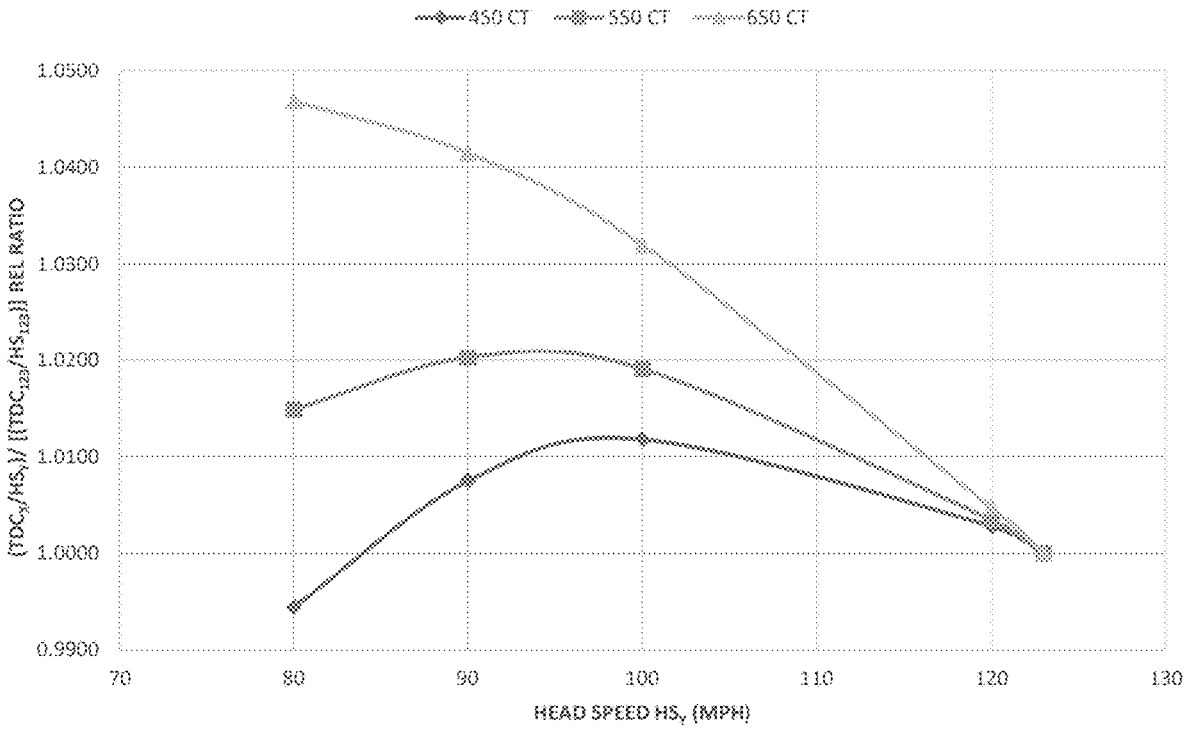

FIG. 3 - 0.77 COR ($RR_{123}$)
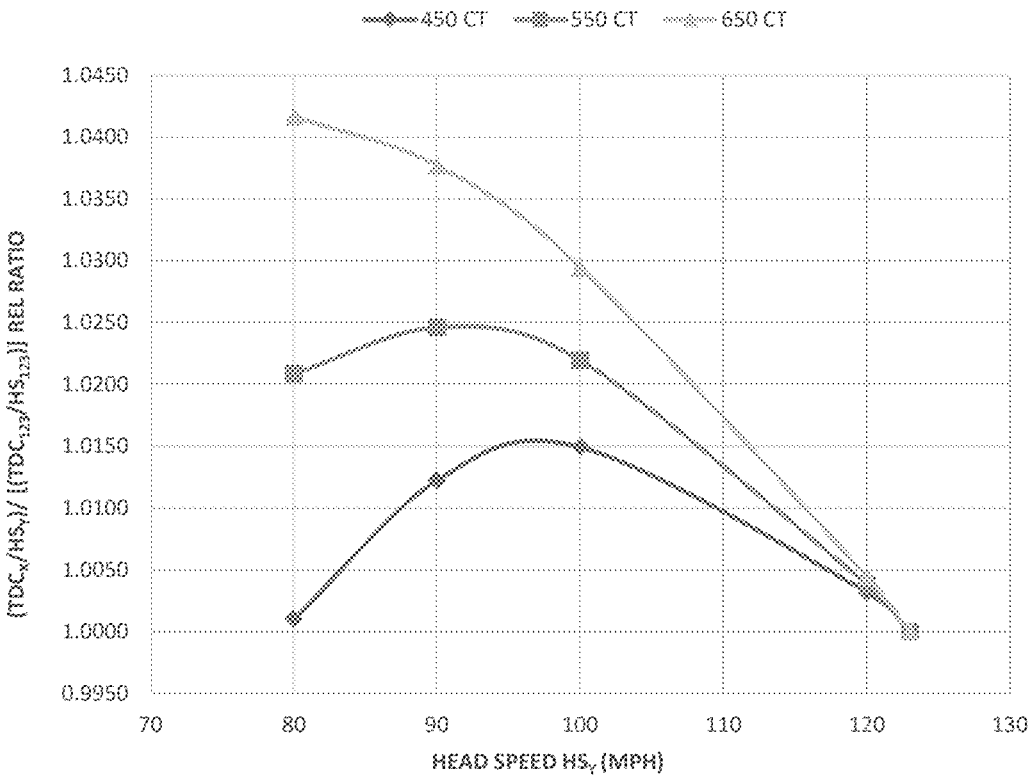

FIG. 4 - 0.82 COR ($RR_{123}$)
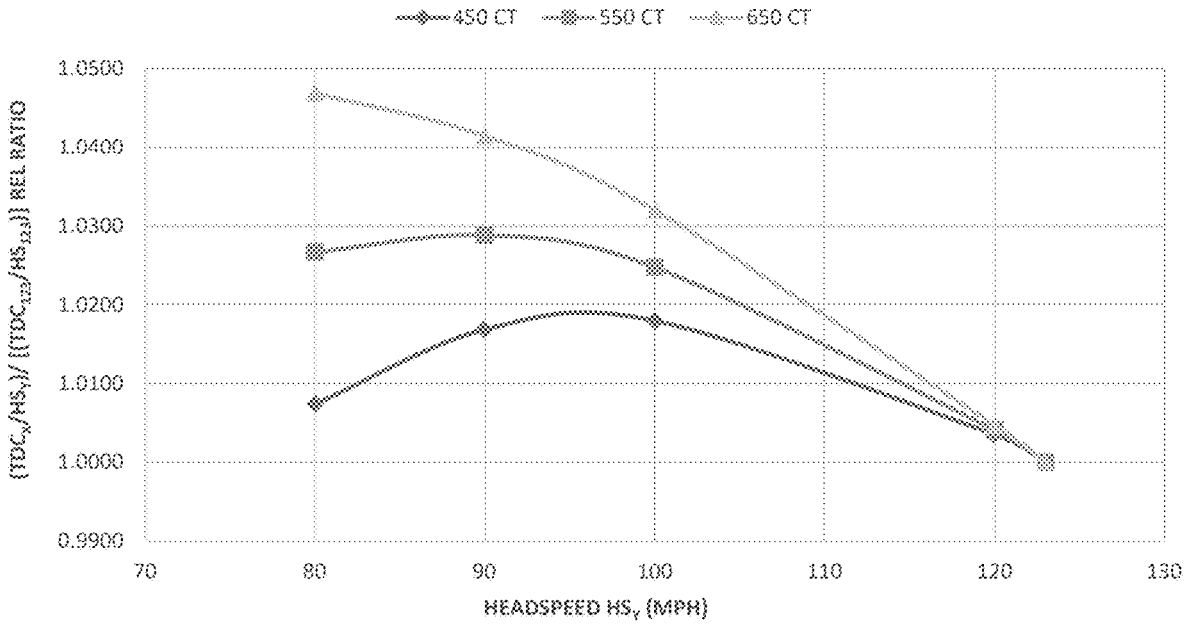

FIG. 5 - 450 CT ($RR_{123}$)
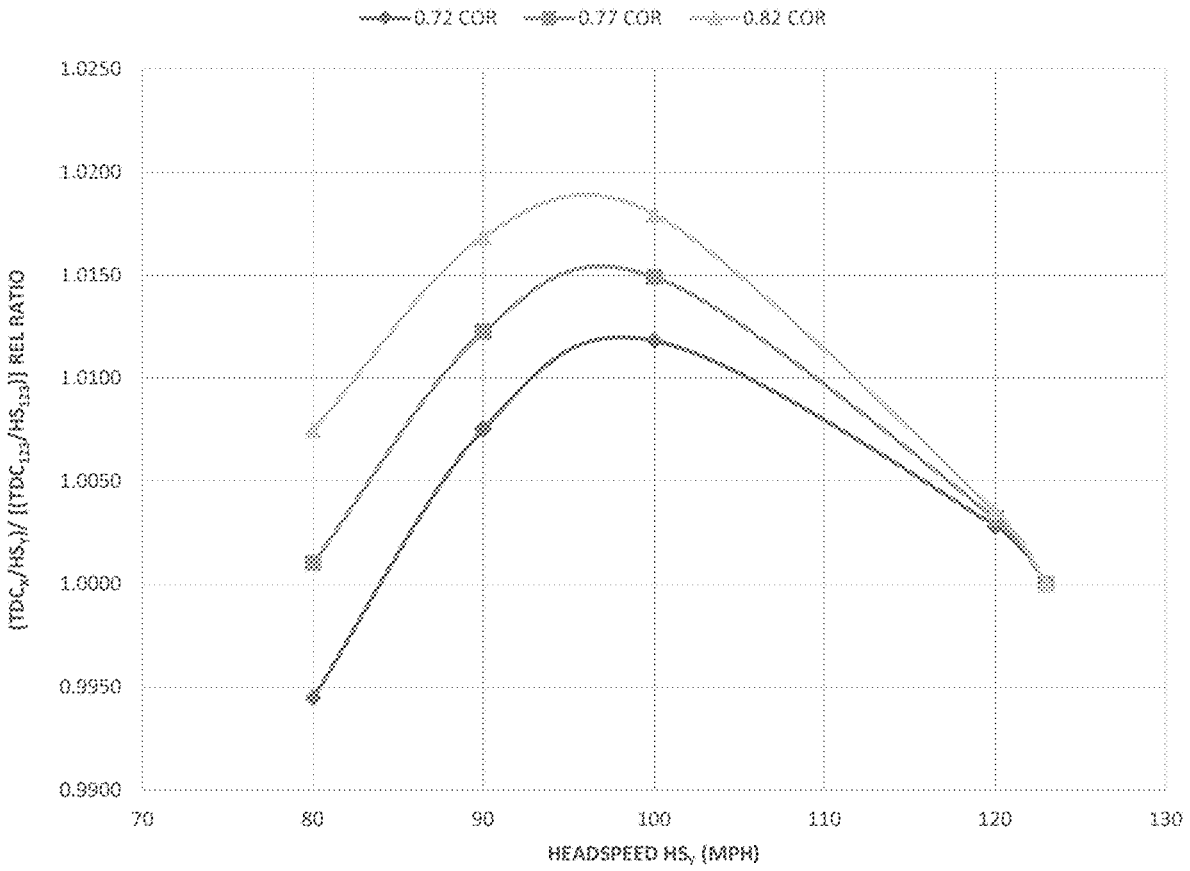

FIG. 6 - 550 CT ($RR_{123}$)
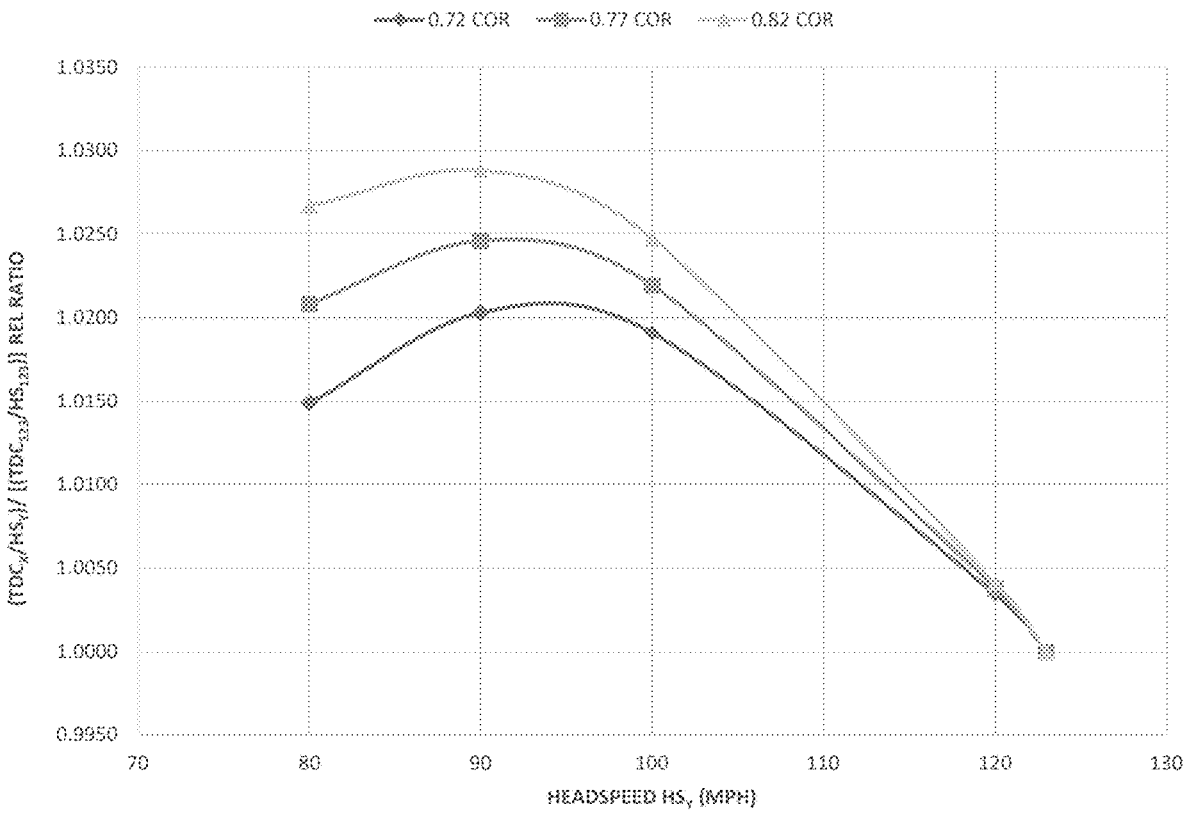

FIG. 7 - 650 CT ($RR_{123}$)
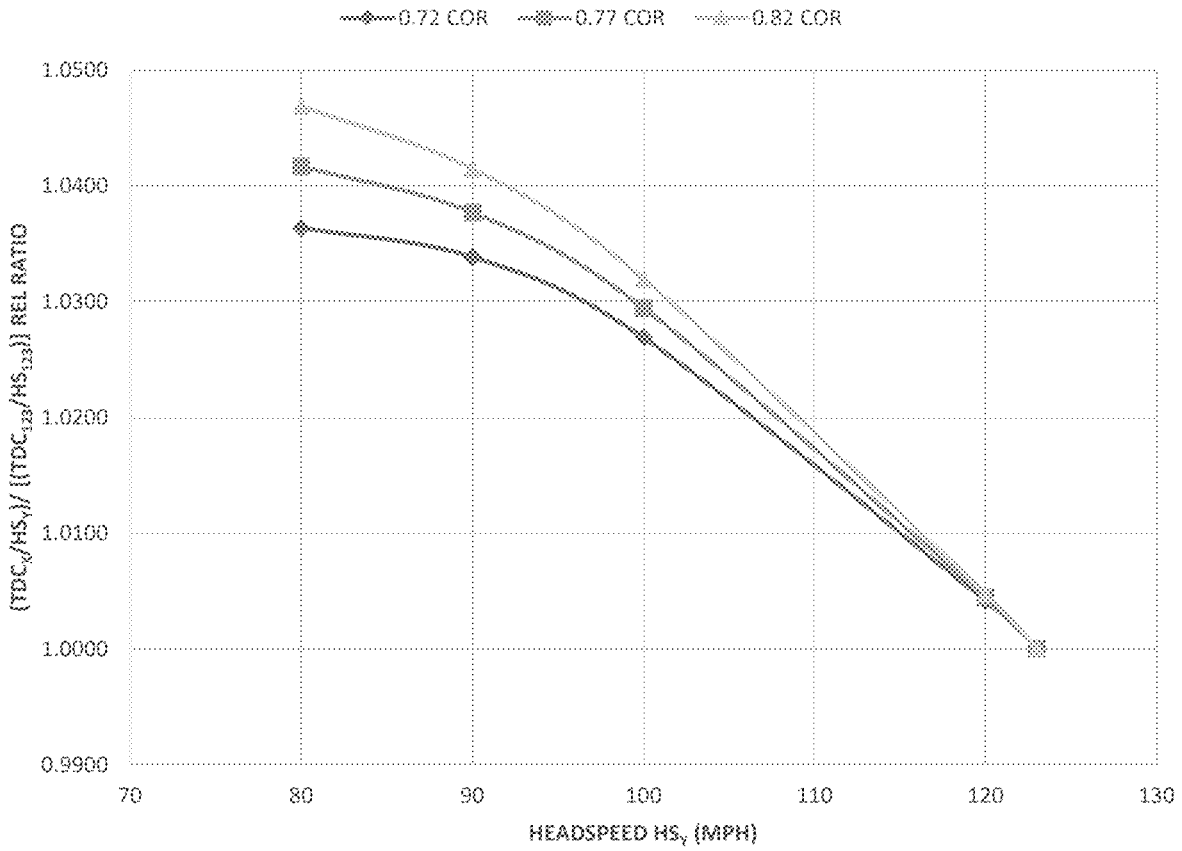

FIG. 8 - 0.72 COR ($RR_{125}$)
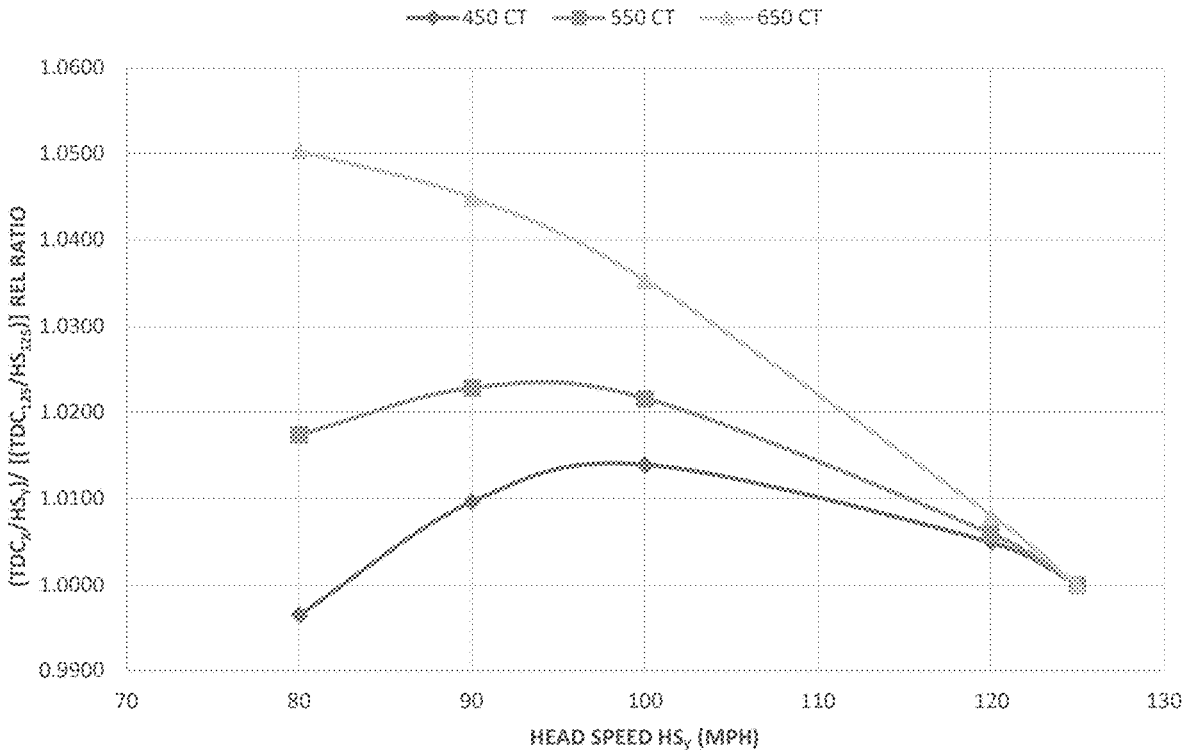

FIG. 9 - 0.77 COR ($RR_{125}$)
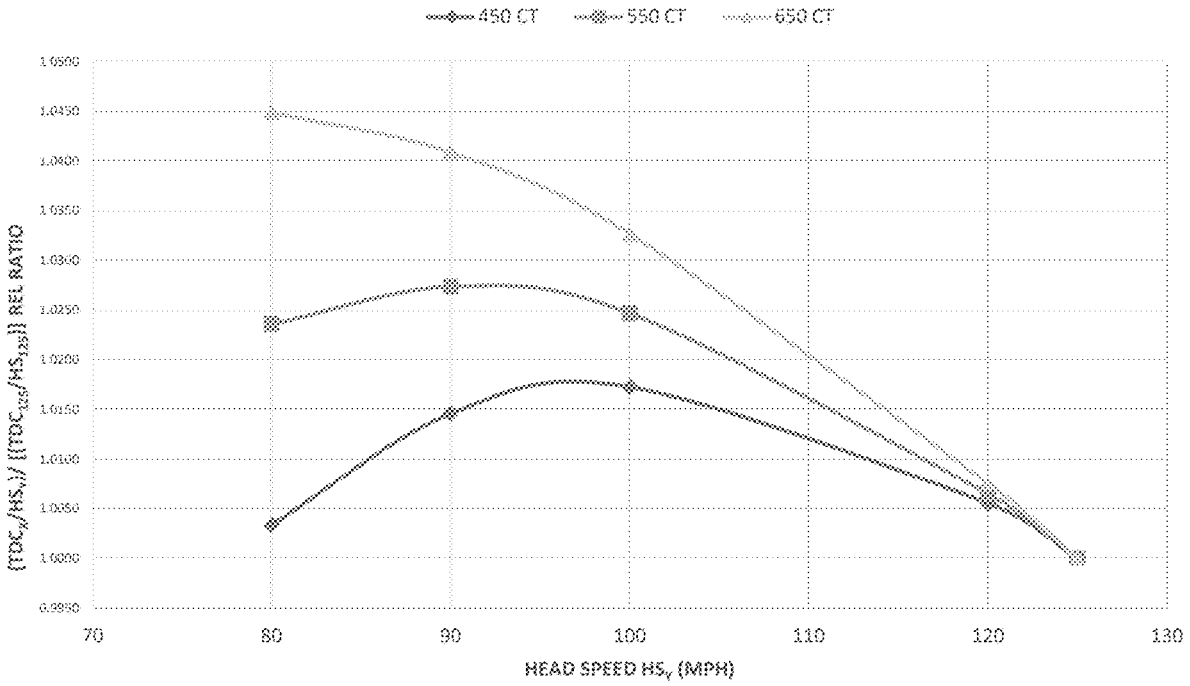

FIG. 10 - 0.82 COR ($RR_{125}$)
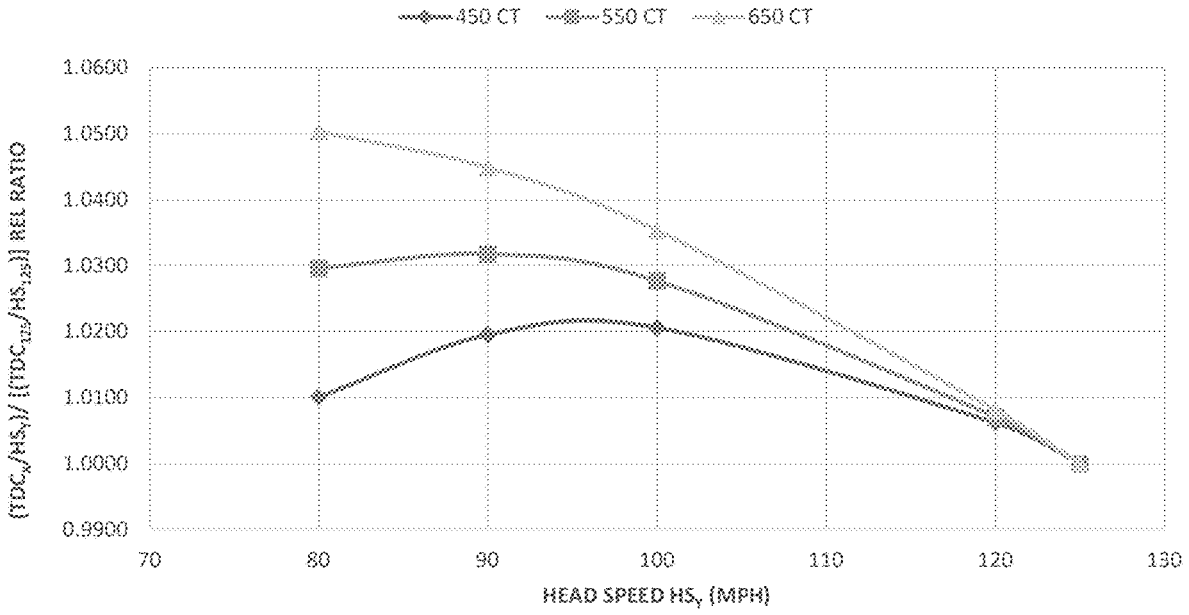

FIG. 11 - 450 CT ($RR_{125}$)
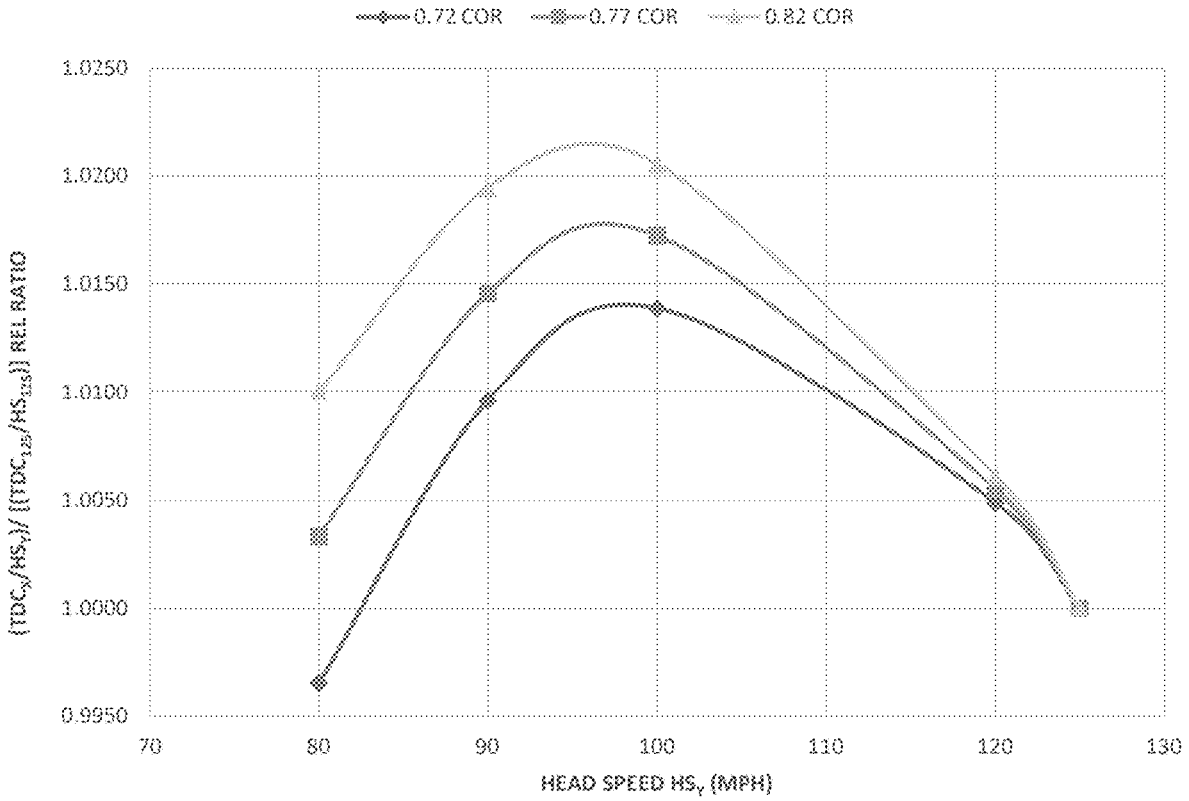

FIG. 12 - 550 CT ($RR_{125}$)
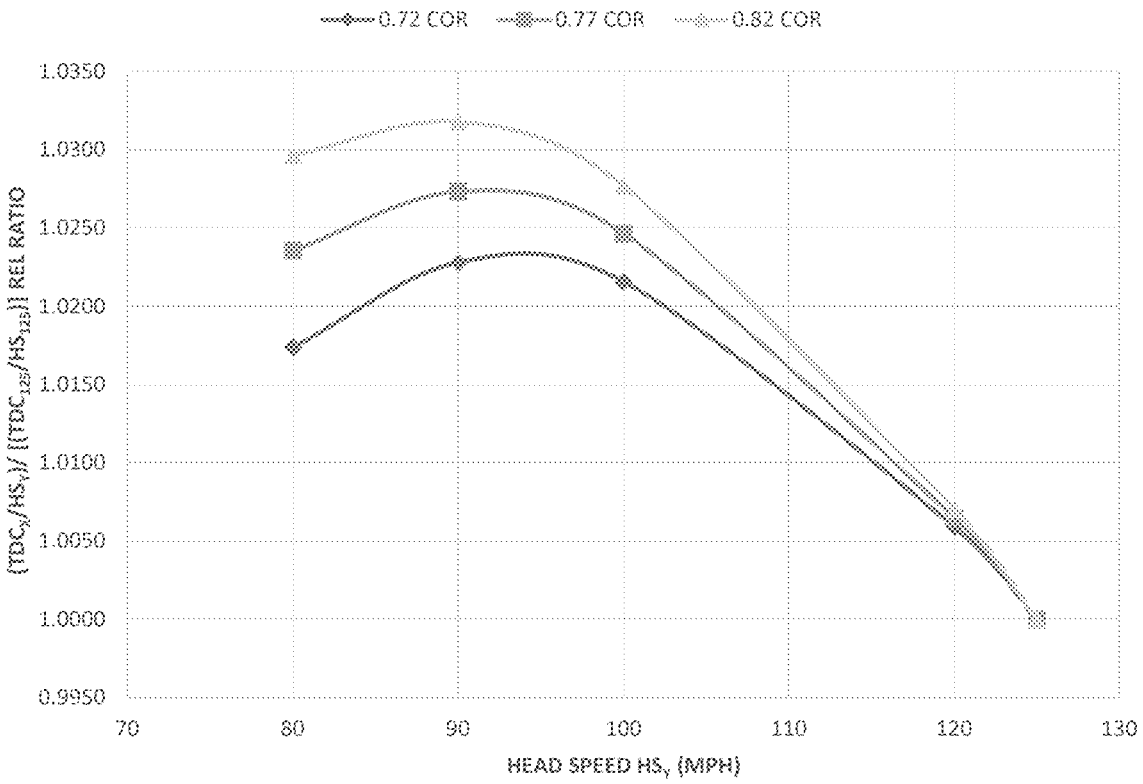

FIG. 13 - 650 CT ($RR_{125}$)
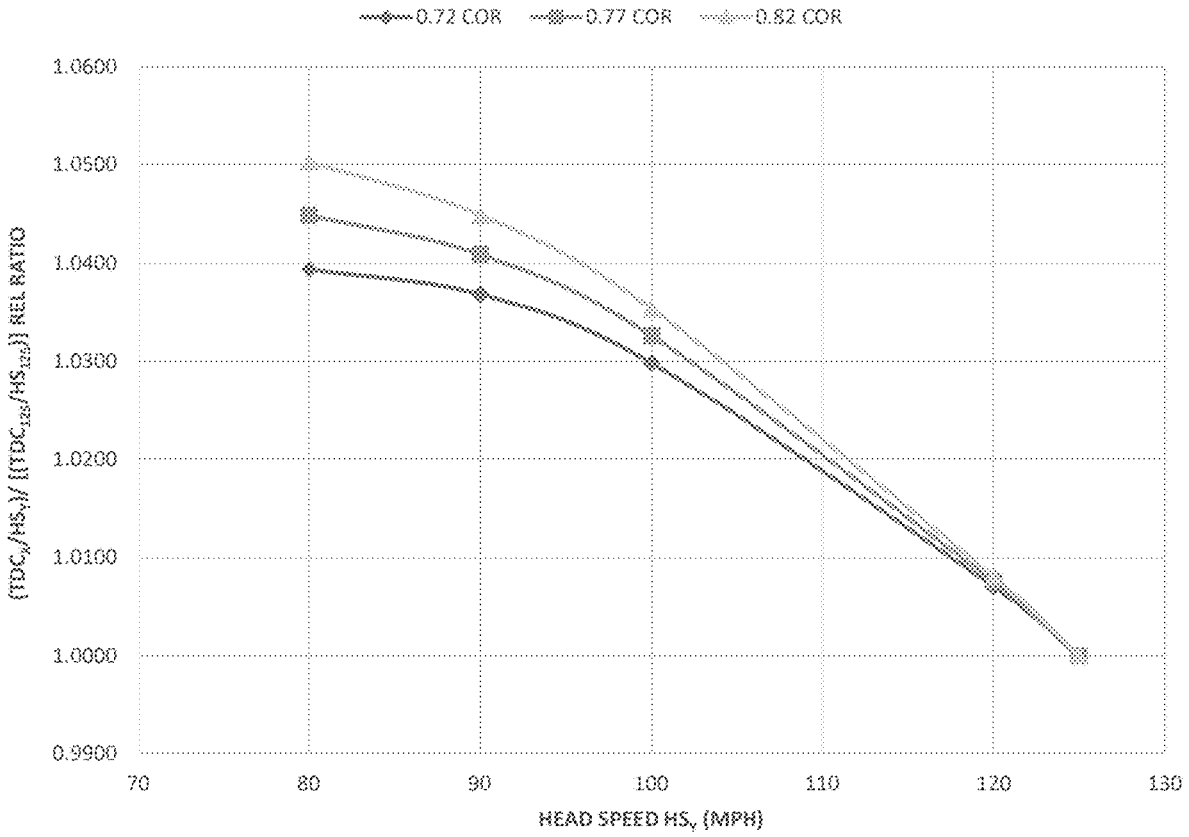

FIG. 14 - 0.72 COR ($RR_{127}$)
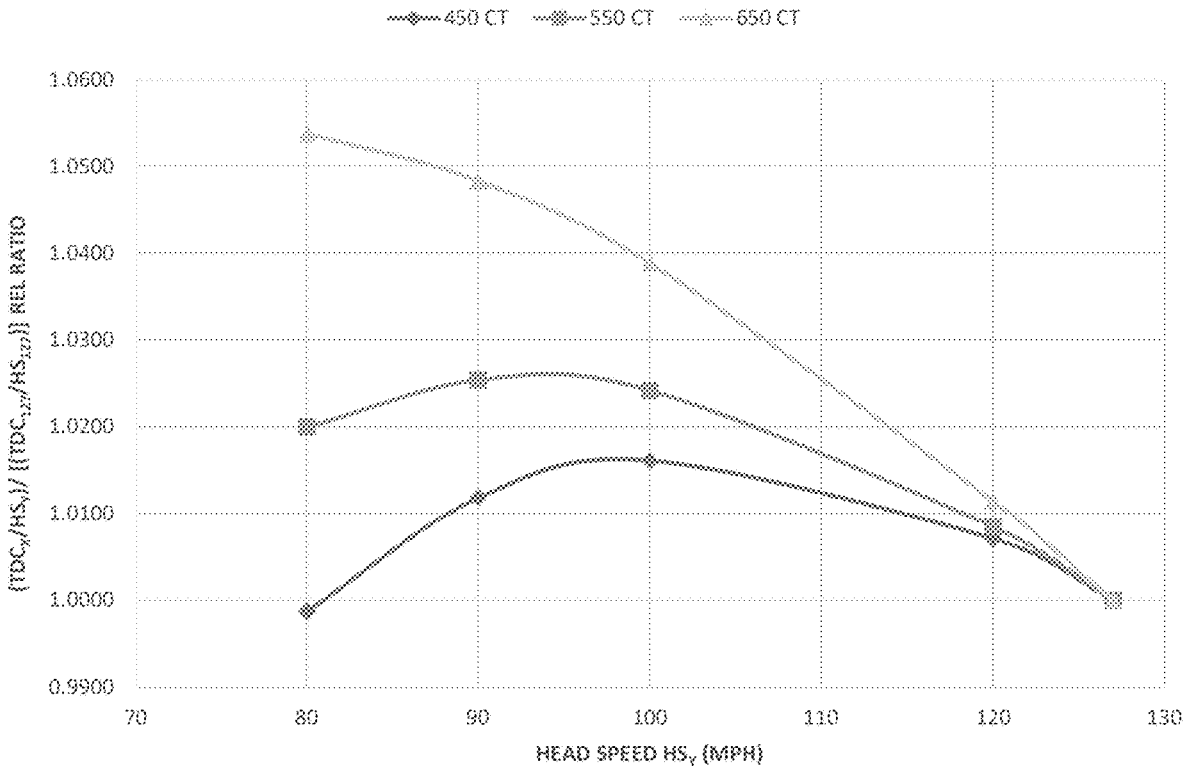

FIG. 15 - 0.77 COR ($RR_{127}$)
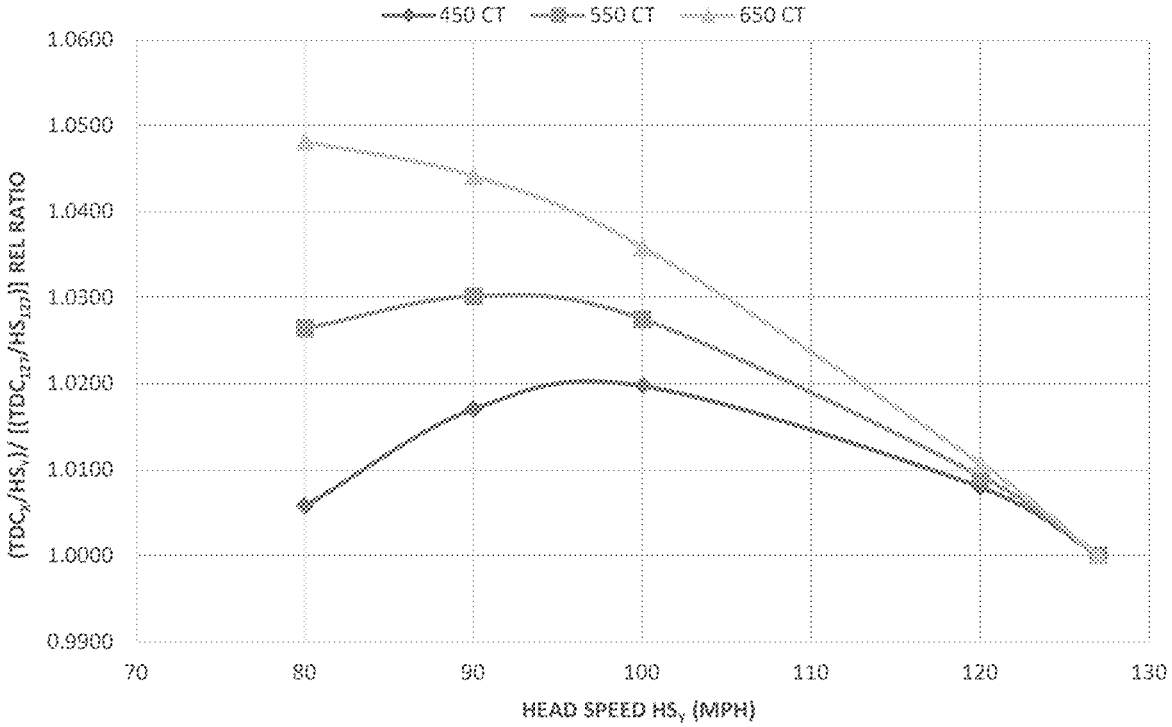

FIG. 16 - 0.82 COR ($RR_{127}$)
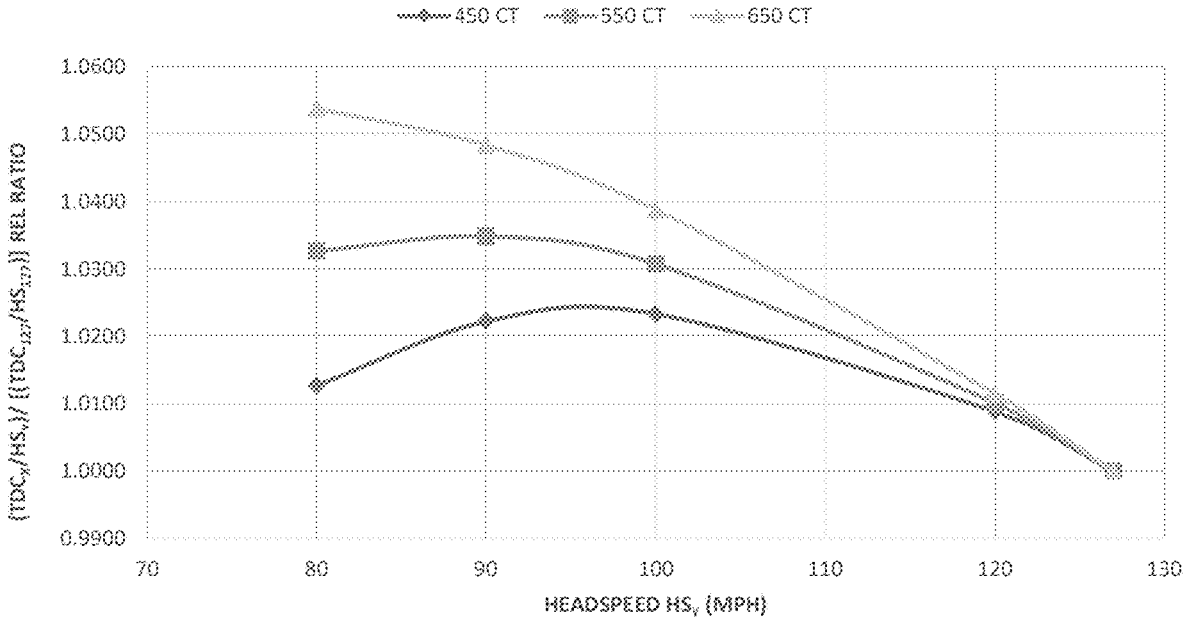

FIG. 17 - 450 CT ($RR_{127}$)
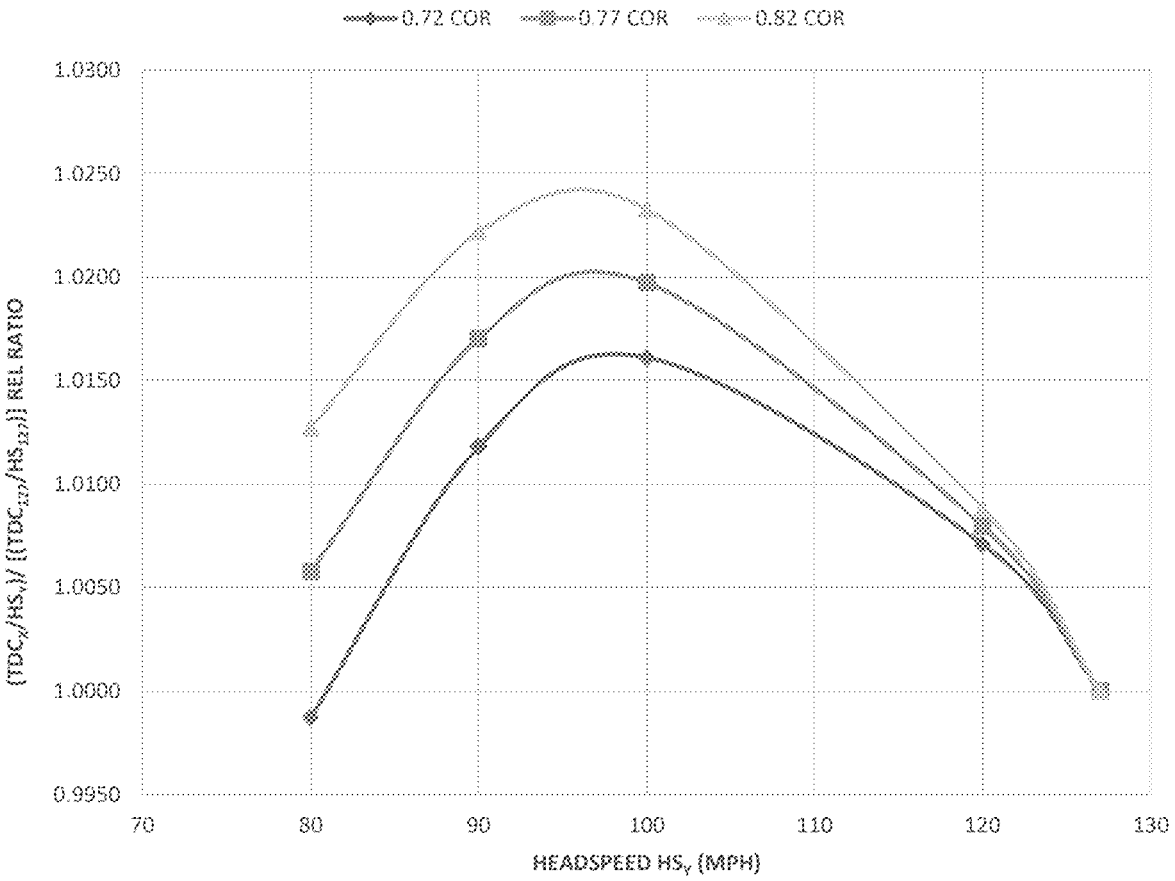

FIG. 18 - 550 CT ($RR_{127}$)
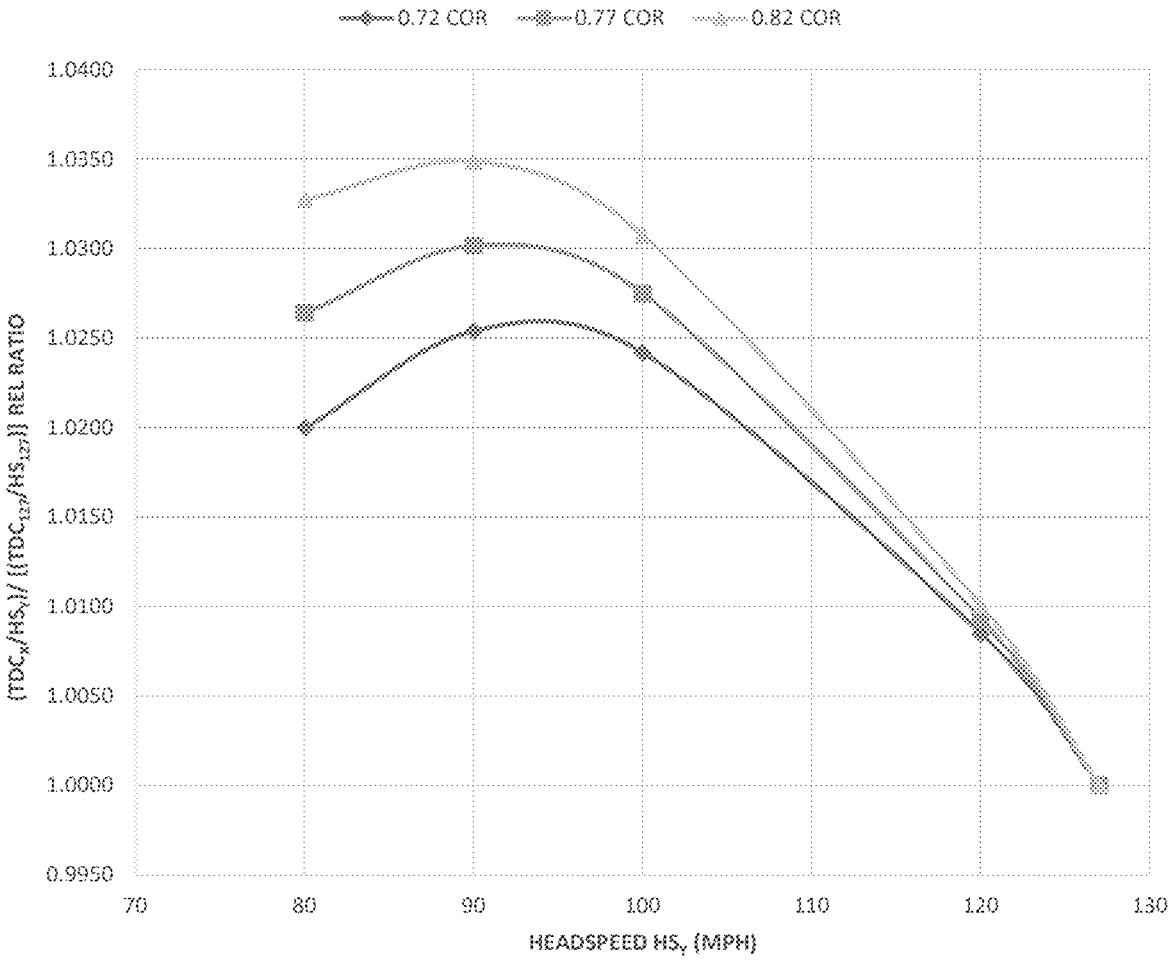

FIG. 19 - 650 CT ($RR_{127}$)
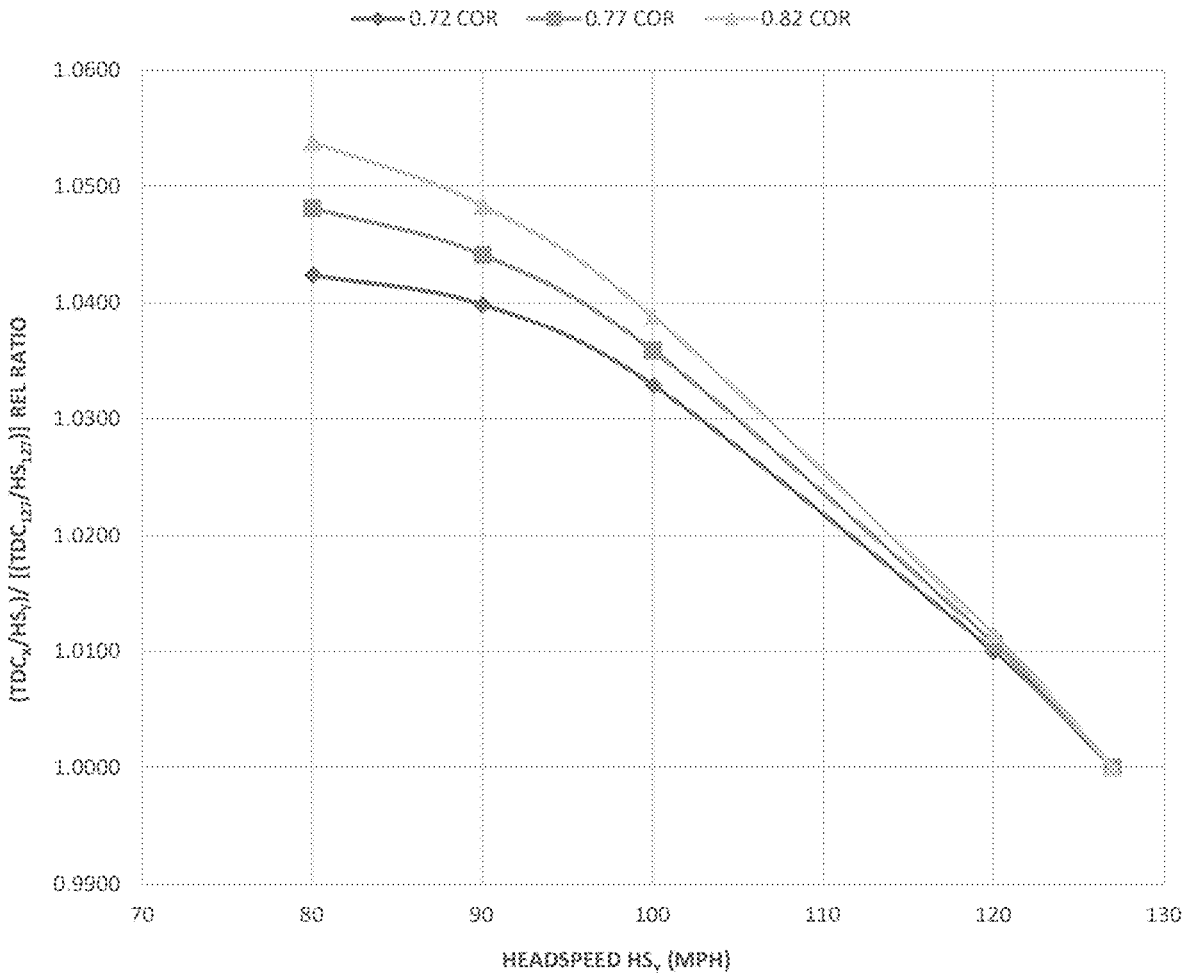

GOLF BALL

CROSS REFERENCE TO RELATED APPLICATION

This application claims the benefit of U.S. Provisional Application No. 63/326,103, filed on Mar. 31, 2022, and U.S. Provisional Application No. 63/391,105, filed on Jul. 21, 2022, both of which are incorporated herein by reference in their entireties.

FIELD OF THE INVENTION

The present invention is a golf ball having a specific distance profile when struck by a driver or iron over a range of clubhead speeds.

BACKGROUND TO THE INVENTION

Golf is a game where it is generally considered that the average recreational golfer has access to and generally uses the same equipment that is available to professional golfers participating on the various professional tours including that run by the Professional Golfers Association known as the PGA Tour.

Thus both the average golfer and the professional tour player have been able to benefit from advances in technology on the ball side as well as concurrent advances in club technology, Such advances on the club side include the use of metal in driver heads (as in the so-called metalwoods in the late 80's early 90's) as well as the transition to larger and more forgiving metalwood driver head volumes which began in. the early 90's and which continued to the current volume limit of 460 cc, first implemented in the early 2000's.

Recent developments in golf ball technology have been focused not only on the development of new golf ball materials and constructions, but also improvements in their aerodynamic properties. Typically, the distance a golf ball travels when struck by a golf club, for example a driver, is a function of the speed at which the ball is travelling and its trajectory in terms of the lift and drag forces the ball experiences during flight. The ball speed is a function of the driver clubhead speed generated by the player at impact, typically more driver head speed equating to more ball speed and thus more distance. The golf ball trajectory is in turn a function of the launch angle of the ball when struck and the spin profile of the ball in flight. To date, golf ball design has had the goal of maximizing the distance the golf ball travels for any given driver speed. Two main areas have been the focus for optimizing distance, i) improving the aerodynamics of the ball by optimizing its dimple pattern design and ii) optimizing the construction of the golf ball in terms of its individual components such as the core, any intermediate layers and its outer cover layer coupled with the choice of the materials of construction of its individual components as well as their physical and chemical properties.

Golf Ball Construction Development

Concomitant with dimple design evolution, the construction of the golf ball has also developed radically over the years. The wound ball which utilized a liquid center with rubber windings around its center was once a top choice of professional players because it was easier to control, even though it sacrificed distance relative to harder balls. Liquid cores were replaced by a variety of synthetic rubber materials, with polybutadiene, a polymer that combines elasticity with the ability to rebound quickly, being the current material of choice for the cores of most golf balls. Modern technology has also replaced the rubber windings with intermediate layers or mantles between the core and outer cover layer which are typically prepared from synthetic thermoplastic. Today, most golf balls are multi-layer balls which contain from one to three intermediate or mantle layers between the core and the outer cover. The material for the outer cover layer has also developed over the years with early golf balls using outer cover layers made from soft balata rubber, which was then replaced by Surlyn® as the material of choice for the outer cover layer. Today's high end balls now utilize the superior durability of polyurethane in their outer cover layers Typically, the distance a golf ball travels when hit with a driver is primarily determined by the swing speed of the golfer with higher swing speeds resulting in longer distances. This is then further impacted by the trajectory of the golf ball as determined by its launch angle as well as the degree of spin imparted to the ball as a result of the interaction between the ball and the golf club face. However, the evolution of the professional game has seen golfers develop their technique and physical abilities such that today's longest drivers of the golf ball can achieve driver clubhead speeds that exceed 130 mph resulting in shots where the golf ball travel more than 300 yards with the longest drivers approaching 320 yards. This can be contrasted with the average recreational golfer whose driver swing speeds can be in the range of 80 to 100 mph with travel distances in the range of 200 to 250 yards Thus, in the case of professional golfers, their prodigious swing speeds when matched with the latest advances in ball and club technology has resulted in driver distances which has rendered many once famous golf courses to become very different in playability than envisaged when they were originally designed. This has come to the point where simply increasing the length of such venues with concomitant increases in real estate and maintenance costs have rendered further increases untenable in many cases. At the same time the recreational golfer has not experienced this change in anywhere like the same degree and thus continues to enjoy many of the same challenges in golf courses as originally designed irrespective of the technology advances described.

One solution to this divergence which is often promoted would be to require all golfers to use golf balls which are constrained in the distance they can travel; however, this would impact the driver distances recreational golfers can attain with their slower swing speeds much more than compared to professional golfers who with their higher swing speeds would still be able to generate sufficient distance. It goes without saying that ideally any contemplated change should not be one that causes the enjoyment of the game to be reduced for the vast majority of golfers.

Another solution contemplated has called for professional golfers to be required to use different equipment than that used by the recreational golfer. The most common solution proposed would be to require professional golfers to use golf balls which are constrained in distance whereas recreational golfers would still be allowed to use today's high performing golf balls. However, this would then change one of the central tenets of golf described earlier namely that that the average recreational golfer has access to and generally uses the same equipment that is available to professional golfers participating on the various professional tours.

Thus, the ideal solution would be to design a golf ball which exhibits reduced distance at the high driver swing speeds generated by professional golfers but much less of a distance loss, when the same ball is hit at the lower swing speeds generated by recreational golfer.

SUMMARY OF THE INVENTION

The present invention seeks to control the distance profile of a golf ball across driver impact speeds from that of the average recreational golfer (at around 80 mph) to that of the male PGA professional (some of whom are reaching clubhead speeds more than 130 mph). Typically golf dimple patterns and ball constructions have been employed to date such that the distance achieved is the highest possible within the USGA distance requirement of 317.0 yards plus a 3.0-yard tolerance, at a driver speed clubhead speed of 120 mph. The balls of the current invention have high contact time ($CT_{143}$) and high coefficients of restitution ($COR_{143}$) and exhibit the optimum flight characteristics in that distances achieved at higher swing speeds are reduced while those at lower swing speeds are maintained or increased.

BRIEF DESCRIPTION OF DRAWINGS

FIG. 2 is a graph showing the change in relative distance, $RR_{123}$, travelled by a golf ball as a function of driver Headspeed for balls having a $COR_{143}$ of 0.72 across a range of $CT_{143}$ values.

FIG. 3 is a graph showing the change in relative distance, $RR_{123}$, travelled by a golf ball as a function of driver Headspeed for balls having a $COR_{143}$ of 0.77 across a range of $CT_{143}$ values.

FIG. 4 is a graph showing the change in relative distance, $RR_{123}$, travelled by a golf ball as a function of driver Headspeed for balls having a $COR_{143}$ of 0.82 across a range of $CT_{143}$ values.

FIG. 5 is a graph showing the change in relative distance, $RR_{123}$, travelled by a golf ball as a function of driver Headspeed for balls having a $CT_{143}$ of 450 microsecs across a range of $COR_{143}$ values.

FIG. 6 is a graph showing the change in relative distance, $RR_{123}$, travelled by a golf ball as a function of driver Headspeed for balls having a $CT_{143}$ of 550 microsecs across a range of $COR_{143}$ values.

FIG. 7 is a graph showing the change in relative distance, $RR_{123}$, travelled by a golf ball as a function of driver Headspeed for balls having a $CT_{143}$ of 650 microsecs across a range of $COR_{143}$ values.

FIG. 8 is a graph showing the change in relative distance, $RR_{125}$, travelled by a golf ball as a function of driver Headspeed for balls having a $COR_{143}$ of 0.72 across a range of $CT_{143}$ values.

FIG. 9 is a graph showing the change in relative distance, $RR_{125}$, travelled by a golf ball as a function of driver Headspeed for balls having a $COR_{143}$ of 0.77 across a range of $CT_{143}$ values.

FIG. 10 is a graph showing the change in relative distance, $RR_{125}$, travelled by a golf ball as a function of driver Headspeed for balls having a $COR_{143}$ of 0.82 across a range of $CT_{143}$ values.

FIG. 11 is a graph showing the change in relative distance, $RR_{125}$, travelled by a golf ball as a function of driver Headspeed for balls having a $CT_{143}$ of 450 microsecs across a range of $COR_{143}$ values.

FIG. 12 is a graph showing the change in relative distance, $RR_{125}$, travelled by a golf ball as a function of driver Headspeed for balls having a $CT_{143}$ of 550 microsecs across a range of $COR_{143}$ values.

FIG. 13 is a graph showing the change in relative distance, $RR_{125}$, travelled by a golf ball as a function of driver Headspeed for balls having a $CT_{143}$ of 650 microsecs across a range of $COR_{143}$ values.

FIG. 14 is a graph showing the change in relative distance, $RR_{127}$, travelled by a golf ball as a function of driver Headspeed for balls having a $COR_{143}$ of 0.72 across a range of $CT_{143}$ values.

FIG. 15 is a graph showing the change in relative distance, $RR_{127}$, travelled by a golf ball as a function of driver Headspeed for balls having a $COR_{143}$ of 0.77 across a range of $CT_{143}$ values.

FIG. 16 is a graph showing the change in relative distance, $RR_{127}$, travelled by a golf ball as a function of driver Headspeed for balls having a $COR_{143}$ of 0.82 across a range of $CT_{143}$ values.

FIG. 17 is a graph showing the change in relative distance, $RR_{127}$, travelled by a golf ball as a function of driver Headspeed for balls having a $CT_{143}$ of 450 microsecs across a range of $COR_{143}$ values.

FIG. 18 is a graph showing the change in relative distance, $RR_{127}$, travelled by a golf ball as a function of driver Headspeed for balls having a $CT_{143}$ of 550 microsecs across a range of $COR_{143}$ values.

FIG. 19 is a graph showing the change in relative distance, $RR_{127}$, travelled by a golf ball as a function of driver Headspeed for balls having a $CT_{143}$ of 650 microsecs across a range of $COR_{143}$ values.

DETAILED DESCRIPTION

Figure 1A:
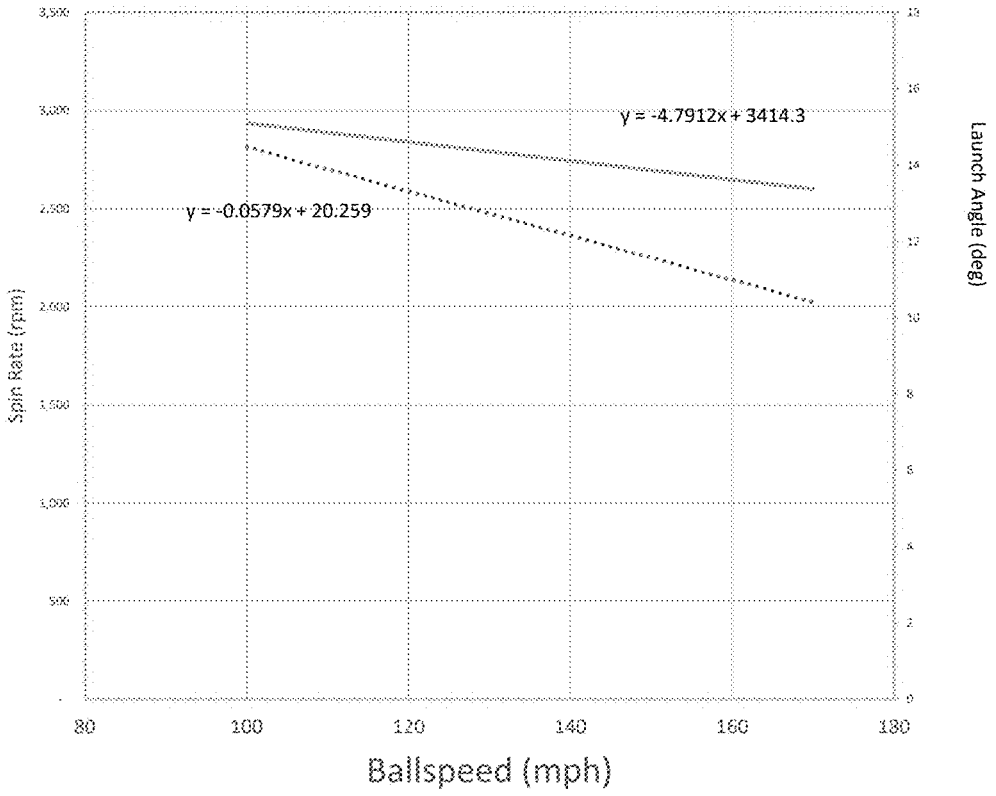
FIG. 1A is a graph showing the correlation between Spin and Launch Angle with Ball speed.

Having briefly described the present invention, the above and further objects, features and advantages thereof will be recognized by those skilled in the pertinent art from the following detailed description of the invention when taken in conjunction with the accompanying drawings.

Any numerical values recited herein include all values from the lower value to the upper value. All possible combinations of numerical values between the lowest value and the highest value enumerated herein are expressly included in this application.

The following definitions are provided to aid the reader and are not intended to provide term definitions that would be narrower than would be understood by a person of ordinary skill in the art of golf ball composition and manufacture.

Definitions

The term "bimodal polymer" refers to a polymer comprising two main fractions and more specifically to the form of the polymer's molecular weight distribution curve, i.e., the appearance of the graph of the polymer weight fraction as a function of its molecular weight. When the molecular weight distribution curves from these fractions are superimposed onto the molecular weight distribution curve for the total resulting polymer product, that curve will show two maxima or at least be distinctly broadened in comparison with the curves for the individual fractions. Such a polymer product is called bimodal. The chemical compositions of the two fractions may be different.

As used herein, the term "core" is intended to mean the elastic center of a golf ball, which may have a unitary construction. Alternatively, the core itself may have a layered construction, e.g., having a spherical "center" and additional "core layers," with such layers being made of the same material as the core center.

The term "cover" is meant to include any layer of a golf ball that surrounds the core. Thus, a golf ball cover may include both the outermost layer and also any intermediate layers, which are disposed between the golf ball core and outer cover layer. "Cover" may be used interchangeably with the term "cover layer."

As used herein the term "equator' and "poles" of a golf ball are defined for a spherical golf ball as follows. In this application most drawings and descriptions consider the two-dimensional golf ball sphere. For definiteness we will take the unit sphere of unit radius in three-dimensional space with center the origin, O. This is the set of satisfying the equation:

$$x^2+y^2+z^2=1.$$

where the xy-plane, is called the equatorial plane, which is the horizontal plane and the z-axis as vertical. Any plane passing through the origin cuts the sphere in a circle called a great circle, so the center of a great circle and the center of the sphere coincide. The equatorial plane meets the sphere of the golf ball in a great circle called the equator.

The line through the center of the golf ball sphere perpendicular to the plane of equator meets the outer surface of the golf ball sphere in two antipodal points called the poles of the golf ball. The poles of the equator are the uuper or north pole N=(0,0,1) and the lower or south pole S=(0, 0, −1).

The term "intermediate layer" may be used interchangeably with "mantle layer," "inner cover layer" or "inner cover" and is intended to mean any layer(s) in a golf ball disposed between the core and the outer cover layer.

In the case of a ball with a core, two intermediate layers, and an outer cover layer the term "inner intermediate layer" may be used interchangeably herein with the terms "inner mantle" or "inner mantle layer" and is intended to mean the intermediate layer of the ball positioned nearest to the core, and the term "outer intermediate layer" may be used interchangeably herein with the terms "outer mantle" or "outer mantle layer" and is intended to mean the intermediate layer of the ball which is disposed nearest to the outer cover layer.

In the case of a ball with a core, three intermediate layers and an outer cover layer the term "inner intermediate layer" may be used interchangeably herein with the terms "inner mantle" or "inner mantle layer" and is intended to mean the intermediate layer of the ball positioned nearest to the core, the term "outer intermediate layer" may be used interchangeably herein with the terms "outer mantle" or "outer mantle layer" and is intended to mean the intermediate layer of the ball which is disposed nearest to the outer cover layer. The term "center intermediate layer" may be used interchangeably herein with the terms "center mantle" or "center mantle layer" and is intended to mean the intermediate layer of the ball positioned between the inner and outer intermediate layers The term "outer cover layer" is intended to mean the outermost cover layer of the golf ball on which, for example, the dimple pattern, paint and any writing, symbol, etc. is placed. If, in addition to the core, a golf ball comprises two or more cover layers, only the outermost layer is designated the outer cover layer. The remaining layers may be designated intermediate layers.

The term outer cover layer is interchangeable with the term "outer cover." If no intermediate layer is introduced between the core and outer cover layer, a so called "two-piece ball" results, if one additional intermediate layer is introduced between the core and outer cover layer, a so called "three-piece ball" results, if two additional intermediate layers are introduced between the unitary core and outer cover layer, a so called "four-piece ball" results, and if three intermediate layers are introduced between the core and outer cover layer, a so called "five-piece ball" results, and so on.

The term "(meth)acrylate" is intended to mean an ester of methacrylic acid and/or acrylic acid.

The term "(meth)acrylic acid copolymers" is intended to mean copolymers of methacrylic acid and/or acrylic acid.

The term "polyurea" as used herein refers to materials prepared by reaction of a diisocyanate with a polyamine.

The term "polyurethane" as used herein refers to materials prepared by reaction of a diisocyanate with a polyol.

The term "reduced equivalent depth dimple" as used herein refers to dimples which have a circular opening and which have a cross sectional profile which results in their exhibiting lower depth than the corresponding spherical single radius dimple of the same volume. Non-limiting examples of such dimple profiles include dual radius, multiple radius and cylindrical dimple profiles The term "seam" as used herein refers to a line formed on the ball by the coming together of the hemispherical mold halves during the molding process used to make a golf ball. In addition to the term "seam" this line is also referred to as the "parting line" of the golf ball as these terms may be used interchangeably herein. (Given that the mold halves are hemispherical the golf ball seam is often coincident with the golf ball equator).

In reference to the golf ball seam, the term "cross seam" as used herein refers to an orientation of the ball such that when placed on the teeing ground the seam is aligned in the horizontal direction and when launched, the ball would spin about the axis described by a line that would pass through the seam (equator) of the ball and that would lie in horizontal plane and be perpendicular to the direction of flight Again, in reference to the golf ball seam, the term "in seam" as used herein refers to an orientation of the ball such that when placed on the teeing ground the seam is aligned in the vertical direction and when launched, the ball would spin about an axis described by a line that would pass through the poles of the ball and that would lie in horizontal plane and be perpendicular to the direction of flight.

The term "Smash Factor" (SF) as used herein relates to the amount of energy transferred from the club head to the golf ball and is calculated by dividing the ball speed by the clubhead speed. For example, if you swing a driver with a clubhead speed of 100 mph and generate a ball speed of 150 mph, the Smash Factor is 1.50. So, the higher the Smash Factor, the more ball speed you are getting for a given clubhead speed. The higher the smash factor the better the energy transfer. A golfer would hope to achieve a smash factor near 1.50 on driver shots. That means for a 100 mph club speed the ball speed would be 150 mph. Tie higher the loft of the club, the lower the smash factor is expected to be. A pitching wedge should have a smash factor near 1.25.

A "thermoplastic" is generally defined as a material that is capable of softening or melting when heated and of hardening again when cooled. Thermoplastic polymer chains often are not cross-linked or are lightly crosslinked using a chain extender, but the term "thermoplastic" as used herein may refer to materials that initially act as thermoplastics, such as during an initial extrusion process or injection molding process, but which also may be cross-linked, such as during a compression molding step to form a final structure.

A "thermoset" is generally defined as a material that crosslinks or cures via interaction with as crosslinking or curing agent. The crosslinking may be brought about by energy in the form of heat (generally above 200 degrees Celsius), through a chemical reaction (by reaction with a curing agent), or by irradiation. The resulting composition remains rigid when set and does not soften with heating. Thermosets have this property because the long-chain polymer molecules cross-link with each other to give a rigid structure. A thermoset material cannot be melted and re-molded after it is cured thus thermosets do not lend themselves to recycling unlike thermoplastics, which can be melted and re-molded.

The term "unimodal polymer" refers to a polymer comprising one main fraction and more specifically to the form of the polymer's molecular weight distribution curve, i.e., the molecular weight distribution curve for the total polymer product shows only a single maximum.

The above term descriptions are provided solely to aid the reader and should not be construed to have a scope less than that understood by a person of ordinary skill in the art or as limiting the scope of the appended claims.

The singular terms "a," "an," and "the" include plural referents unless context clearly indicates otherwise. The word "comprises" indicates "includes." It is further to be understood that all molecular weight or molecular mass values given for compounds are approximate and are provided for description. The materials, methods, and examples are illustrative only and not intended to be limiting. Unless otherwise indicated, description of components in chemical nomenclature refers to the components at the time of addition to any combination specified in the description, but does not necessarily preclude chemical interactions among the components of a mixture once mixed.

Any numerical values recited herein include all values from the lower value to the upper value in increments of one unit provided that there is a separation of at least 2 units between any lower value and any higher value. As an example, if it is stated that the amount of a component or a value of a process variable is from 1 to 90, preferably from 20 to 80, more preferably from 30 to 70, it is intended that values such as 15 to 85, 22 to 68, 43 to 51, 30 to 32 etc., are expressly enumerated in this specification. For values, which have less than one unit difference, one unit is considered to be 0.1, 0.01, 0.001, or 0.0001 as appropriate. Thus, all possible combinations of numerical values between the lowest value and the highest value enumerated herein are said to be expressly stated in this application.

The present invention can be used to form golf balls of any desired size. "The Rules of Golf" by the USGA dictate that the size of a competition golf ball must be at least 1.680 inches in diameter; however, golf balls of any size can be used for leisure golf play. The preferred diameter of the golf balls is from about 1.670 inches to about 1.800 inches. Oversize golf balls with diameters above about 1.760 inches to as big as 2.75 inches also are within the scope of the invention.

Shore D hardness can be measured in accordance with ASTM D2240. Hardness of a layer can be measured on the ball, perpendicular to a land area between the dimples (referred to as "on-the-ball" hardness). The Shore D hardness of a material prior to fabrication into a ball layer can also be measured (referred to as "material" hardness). Unless otherwise specified the Shore D measurements quoted for the layers of the golf balls of the present invention are measured on the ball.

Core or ball diameter may be determined using standard linear calipers or a standard size gauge.

Compression may be measured by applying a spring-loaded force to the sphere to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus, more compressible, softer materials will have lower Atti gauge values than harder, less compressible materials. The value is taken shortly after applying the force and within at least 5 secs if possible. Compression measured with this instrument is also referred to as PGA compression. The approximate relationship that exists between Atti or PGA compression and Riehle compression can be expressed as: (Atti or PGA compression)=(160-Riehle Compression). Thus, a Riehle compression of 100 would be the same as an Atti compression of 60.

The distance a conforming ball can travel is subject to the Overall Distance Standard promulgated by the USGA. This standard states that if the overall distance of a test ball is found to exceed the limit of 317.0 yards plus a 3.0-yard tolerance, then the ball is deemed non-conforming. The overall distance a golf ball travels consists of its carry distance i.e. the distance to its first landing point to which is added the additional distance resulting from the golf ball's subsequent bounce and roll.

Generally, the distance protocol utilizes a robot test apparatus which is initially set up to swing a standard golf club driver, of known parameters, to strike a standard test ball, of known parameters, such that it delivers the club head to the ball at a clubhead speed of 120±0.5 mph generating a launch angle of 10±0.5 degrees and a spin rate 2,520±120 rpm. The resulting robot set up is then used to strike a given test ball and the carry distance measured. The full protocol is publicly available as published by the R&A Rules Limited and United States Golf Association named "Overall Distance Standard and Symmetry Test Protocol TPX3006 Rev. 3.0 9 Apr. 2019", the entire contents of which are herein incorporated by reference.

To this distance is then added the calculated bounce and roll distance as calculated from the golf balls terminal or landing angle where the terminal angle is defined as the vertical angle relative to the horizon of the golf ball's center of gravity movement when the ball has the same height as where it was launched from (resting point prior to impact).

The calculated bounce and roll distance is then determined from the balls using the correlation published by the United States Golf Association, R&A Rules Limited dated Mar. 16, 2021 entitled "Proposed Bounce Model for Use in Evaluating Optimum Overall Distance", the entire contents of which are herein incorporated by reference.

The bounce and roll distance is calculated from the golf balls terminal or landing angle using the expression:

$$y=-0.9774x+55.568$$

where y is bounce and roll distance in yards and x is the terminal or landing angle of the ball. Under this equation if a golf balls trajectory indicates a landing angle of 39 degree then a bounce and carry distance of 17.4 yards would be added to the balls carry distance in order to calculate the test balls total overall distance. The negative value indicates that the steeper the angle, the shorter the ultimate bounce and roll.

The paper also discloses another equation for determining the bounce and roll distance ie:

$$y=79.1-1.6\alpha$$

where y is the bounce and roll distance in yards and a is the terminal or landing angle of the ball.

Under this equation if a golf balls trajectory indicates a landing angle of 39 degree then a bounce and carry distance of 16.7 yards would be added to the balls carry distance in order to calculate the test balls total overall distance.

The coefficient of restitution ("COR") of a golf ball is the ratio of the relative velocity after direct impact of the ball with a stationary surface to the relative velocity before impact. As a result, the COR can vary from 0 to 1, with 1 being equivalent to a completely elastic collision and 0 being equivalent to a completely inelastic collision. Since a ball's COR directly influences the ball's initial velocity after club collision and travel distance, this characteristic in the designing and test of golf balls. One conventional technique for measuring COR uses a golf ball or sphere, an air cannon, and a stationary steel plate. A pair of ballistic light screens, which measure ball velocity, are spaced apart and located between the air cannon and the steel plate. The golf ball is fired from the air cannon toward the steel plate over a range of test velocities from 50 ft/s to 180 ft/s. As the ball travels toward the steel plate, it activates each light screen so that the time at each light screen is measured. This provides an incoming time period proportional to the ball incoming velocity. The ball impacts the steel plate and rebounds though the light screens, which again measure the time period required to transit between the light screens. This provides an outgoing transit time period proportional to the ball outgoing velocity. The USGA requires that when measuring the COR, the rebound velocity of the ball shall be measured at a distance beginning no less than 7 inches (177.8 mm), and no more than 9 inches (228.6 mm) from the impact target. The gauge distance for velocity measurement should be no more than 18 inches (457.2 mm).

The COR can be calculated by the ratio of the outgoing transit time period to the incoming transit time period, $COR=T_{out}/T_{in}$. The golf ball COR's is often quoted relative to the test velocity of 143 ft/sec in which case the abbreviation $COR_{143}$ is used. As used herein, the COR quoted may also be one measured at a test velocity of 125 ft/sec in which case the abbreviation $COR_{125}$ is used.

The initial velocity of a golf ball after impact with a golf club is governed by the United States Golf Association ("USGA"). The USGA initial velocity limit is related to the ultimate distance that a ball may travel (317 yards) and is also related to the. The full protocol used by the USGA to determine ball initial velocity is published by the R&A Rules Limited and United States Golf Association in the document named "INITIAL VELOCITY TEST PROTOCOL TPX3007 Rev. 2.1, 9 Apr. 2019", the entire contents of which are herein incorporated by reference.

The protocol also requires that the golf ball contact time ($CT_{143}$) be measured. The $CT_{143}$ is defined as the time of contact between the ball and the barrier in microseconds at an impact speed of 143.8 ft/s (43.83 m/s).

Typically, a ball is tested over a range of speeds, such that: a) The impact speeds should not be different from 143.8 ft/s by more than 15 ft/s (4.57 m/s) and b) Sufficient measurements are made at speeds above and below the target speed as to allow for linear interpolation to 143.8 ft/s The Initial Velocity (IV) of the golf ball (ft/s) is calculated according to the following:

$$IV=136.8+136.3*COR_{143}+0.019*CT_{143}$$

where $COR_{143}$ is the coefficient of restitution of the ball measured at 143 ft/sec, and $CT_{143}$ is the contact time in microseconds at an impact speed of 143.8 ft/s (43.83 m/s)

The data obtained is used to ascertain the conformance of the golf balls to the USGA initial velocity standard which requires that the IV of the ball shall not be greater than 250 feet (76.2 m) per second. A maximum tolerance of 2% is allowed.

The various measurements of COR, IV and CT as used herein were measured using the Model PTM3 Golf Ball Testing Machine, supplied by Hye Precision Products of Perry, Georgia.

In addition to directly measuring the distance a golf ball travels using robot testing, we have now developed a series of model equations which allow us to predict a golf balls total distance under a variety of headspeed impacts.

First, a model was developed which allows the Predicted Ball Speed (PBS) to be calculated over from a knowledge of the headspeed (HS, mph) and the golf balls $CT_{143}$ and $COR_{143}$. The model was developed from the analysis of 12 golf balls having a range of $CT_{143}$ of 398 to 617 microsec and $COR_{143}$ values of 0.744 to 0.827, each of which were hit four times with a driver and the numbers averaged. The robot testing apparatus was set up as for the USGA standard test, (the full protocol of which is publicly available as published by the R&A Rules Limited and United States Golf Association named "Overall Distance Standard and Symmetry Test Protocol TPX3006 Rev. 3.0 9 Apr. 2019") for carry distance, but employing three different driver Head Speeds (HS) of 126 mph, 105 mph and 85 mph at a Launch Angle of 12 degrees and a backspin rate of 2600 rpm and using either a TaylorMade M3 or R11 commercially available driver and a commercially available 2014 TaylorMade TPX golf ball as the Setup ball. The set up data are summarized in Table 1.

TABLE 1

| Head Speed (mph) | Driver Head Model | Driver loft (deg) | Setup ball | Setup ball speed (mph) | Setup launch angle (deg) | Setup back-spin (rpm) |
|---|---|---|---|---|---|---|
| 126 | TaylorMade M3 | 8.5 | TaylorMade TPX 2014 | 175 | 12 | 2600 |
| 105 | TaylorMade M3 | 8.5 | TaylorMade TPX 2014 | 150 | 12 | 2600 |
| 85 | TaylorMade R11 | 10.5 | TaylorMade TPX 2014 | 125 | 12 | 2600 |

From the resulting data a universal equation was determined which allows Ball Speed to be predicted (PBS) from the Head Speed and the ball's Coefficient of Restitution ($COR_{143}$) and Contact Time ($CT_{143}$) by the following equation:

$$PBS=(-21.2+HS*1.311)+(4.8+HS*0.5231)*COR_{143}+(0.06698-HS*0.0008066)*CT_{143}$$

The Spin (SP) and Launch Angle, (LA) of a golf ball was then calculated from its Ball Speed (BS) using a model based on an analysis of the driver shots of over 4,000 golfers each hitting multiple golf shots on a swing analyzer which determined the ball speed, launch angle and spin on the golf ball for every shot. Analysis of these data allowed the development of equations which relate the Ball Speed (BS) to both Spin, SP, and Launch Angle, LA (see FIG. 1A).

$$SP(rpm)=-4.7912*BS(mph)+3414.3$$

$$LA(degs)=-0.0579*BS(mph)+20.259$$

The golf ball dimple pattern described herein as Example 1 was then tested in the USGA's Indoor Test Range ("ITR") facility as described in the USGA Notice to Manufacturers entitled "Indoor Test Range (ITR) Equipment Change" dated Oct. 18, 2017, the entire contents of which are incorporated by reference herein.

Golf balls were tested over the range of 15 different conditions of launch speed and launch spin as described in the USGA Notice to Manufacturers entitled "Screening Golf Balls for Overall Distance and Symmetry" Notice #B2013-001, having an effective date of Jan. 1, 2014, ("USGA Screening Conditions") and the methods described in U.S. Pat. No. 6,186,002 B1 issuing on Feb. 13, 2001, the entire contents of each of which are incorporated by reference herein. The resulting aerodynamic data are summarized in Table 2.

TABLE 2

| Condition | Nominal Speed ft/s | Nominal Spin rev/s | Shots per condition | mean Reynolds No. Re ($\times 10^{-5}$) | mean Spin Ratio SR | mean Coefficient of drag $C_D$ | mean Coefficient of lift $C_L$ |
|---|---|---|---|---|---|---|---|
| 1 | 278 | 35 | 6 | 2.1746 | 0.0605 | 0.2213 | 0.1304 |
| 2 | 278 | 52 | 6 | 2.1725 | 0.0823 | 0.2263 | 0.1480 |
| 3 | 220 | 30 | 6 | 1.7288 | 0.0601 | 0.2162 | 0.1272 |
| 4 | 220 | 38 | 6 | 1.7238 | 0.0854 | 0.2213 | 0.1471 |
| 5 | 220 | 49 | 6 | 1.7216 | 0.1056 | 0.2287 | 0.1655 |
| 6 | 161 | 29 | 6 | 1.2705 | 0.0897 | 0.2177 | 0.1484 |
| 7 | 161 | 47 | 6 | 1.2616 | 0.1399 | 0.2413 | 0.1972 |
| 8 | 130 | 30 | 6 | 1.0284 | 0.1093 | 0.2278 | 0.1718 |
| 9 | 130 | 39 | 6 | 1.0241 | 0.1441 | 0.2485 | 0.2122 |
| 10 | 130 | 48 | 6 | 1.0218 | 0.1753 | 0.2656 | 0.2357 |
| 11 | 108 | 29 | 6 | 0.8570 | 0.1277 | 0.2393 | 0.1939 |
| 12 | 108 | 44 | 6 | 0.8560 | 0.1819 | 0.2770 | 0.2487 |
| 13 | 96 | 30 | 6 | 0.7486 | 0.1530 | 0.2617 | 0.2235 |
| 14 | 95 | 36 | 6 | 0.7442 | 0.1803 | 0.2799 | 0.2474 |
| 15 | 93 | 42 | 6 | 0.7245 | 0.2131 | 0.3064 | 0.2745 |

The measured lift and drag values in Table 2 were then inserted into the modeled equations for lift and drag i.e., $C_L$(Re, SR) and $C_D$(Re, SR), below as described the proceedings of The World Scientific Congress of Golf, St. Andrews, Scotland, 22-26th July, 2002 in Chapter 30 entitled by Generally Applicable Model for the Aerodynamic Behavior of Golf Balls by S. J. Quintavalla, United States Golf Association., first published 2022, by Routledge, London, the entire contents of which chapter are herein incorporated by reference, to find all the unknown coefficients ($a_1$, $a_2$, $a_3$, $b_1$, $b_2$, $b_3$, $c_1$, $c_2$, $c_3$, $c_4$ and $d_1$ and $d_2$) using a linear regression model.

$$C_L(\mathrm{Re}, SR) = \left[a_1 + \frac{a_2}{\mathrm{Re}^5} + \frac{a_3}{\mathrm{Re}^7}\right] + \left[b_1 + b_2\frac{\ln(\mathrm{Re})}{\mathrm{Re}^2} + \frac{b_3}{\mathrm{Re}^2}\right]\cdot SR$$

$$C_D(\mathrm{Re}, SR) = \left[c_1 + \frac{c_2}{\mathrm{Re}^3} + \frac{c_3}{\mathrm{Re}^5} + \frac{c_4}{\mathrm{Re}^7}\right] + \left[d_1 + d_2\frac{\ln(\mathrm{Re})}{\mathrm{Re}^2}\right]\cdot SR^2$$

Where the spin ratio SR=(|ω|r)/|V| and the Reynolds No. Re=(2|V|r)/v.

The values of SR and Re are computed using the following parameters: r is the radius of the ball, v is the kinematic viscosity of the air, |ω| is the magnitude of the spin rate of the ball in radian per second (which is equal to 2πS where S is the spin rate in revolutions per second), and |V| is the magnitude of the velocity of the ball (which is the square root of the sum of the horizontal velocity $V_x$ and vertical velocity $V_y$.

The above equations for modeled $C_L$(Re, SR) and $C_D$(Re, SR), and the calculated coefficients ($a_1$, $a_2$, $a_3$, $b_1$, $b_2$, $b_3$, $c_1$, $c_2$, $c_3$, $c_4$ and $d_1$ and $d_2$) allow drag, $C_D$, and lift, $C_L$, coefficients to be characterized as a function of Re and SR during flight and entire trajectory. This in turn allows us to compute modeled drag and lift coefficients for every speed and spin condition at each point of the golf ball trajectory during its flight.

These estimates of $C_L$ and $C_D$ for different Re and SR values were then incorporated into a trajectory model (TM) which uses the numerical method of Runge-Kutta to solve nonlinear equations of motion to simulate golf ball projectile trajectory given the initial launch conditions. The trajectory model used is specifically described in U.S. Pat. No. 6,186,002 B1, column 6 lines 12 through 59, which are incorporated herein in its entirety. This method is described in Chapter 8 of Numerical Methods for Engineers, Prentice Hall, 1996, by Ayyub, B. M., and R. H. McCuen: the entire contents of which chapter are incorporated by reference herein. Note that |V| and ω denote the speed and spin of the ball at different points in its trajectory. Whereas the ball speed BS and ball spin SP described previously are only equal to |V| and ω as it leaves the club face i.e., at time t=0 in the trajectory equation. Ball speed BS, ball spin SP and launch angle LA are used to compute the initial launch conditions of the ball which go into solving its trajectory equations. These initial conditions for V and ω are given as, $$|V|^{t=0}=\mathrm{BS},\ |\omega|^{t=0}=\mathrm{SP},\ V_x^{t=0}=\mathrm{BS}\cdot\cos(\mathrm{LA}),\ V_y^{t=0}=\mathrm{BS}\cdot\sin(\mathrm{LA})$$

The trajectory model (TM) simulates the trajectory of the ball from its initial launch conditions at t=0 to a time when the ball lands back onto the ground i.e., $t=t^{carry}$. This distance moved from its initial launch time t=0 to time $t=t^{carry}$ gives the carry distance of the golf ball.

The velocity $V^{carry}$ the golf ball has when it reaches the ground can be used to compute the angle it makes on landing, called the terminal angle $\alpha=\tan 1(V_y^{carry}/V_x^{carry})$, which can be used to model the bounce and roll distance as described earlier. Combination of the carry distance and the bounce and roll distance allows calculation of the total distance travelled by the golf ball (TD).

Figure 1B:
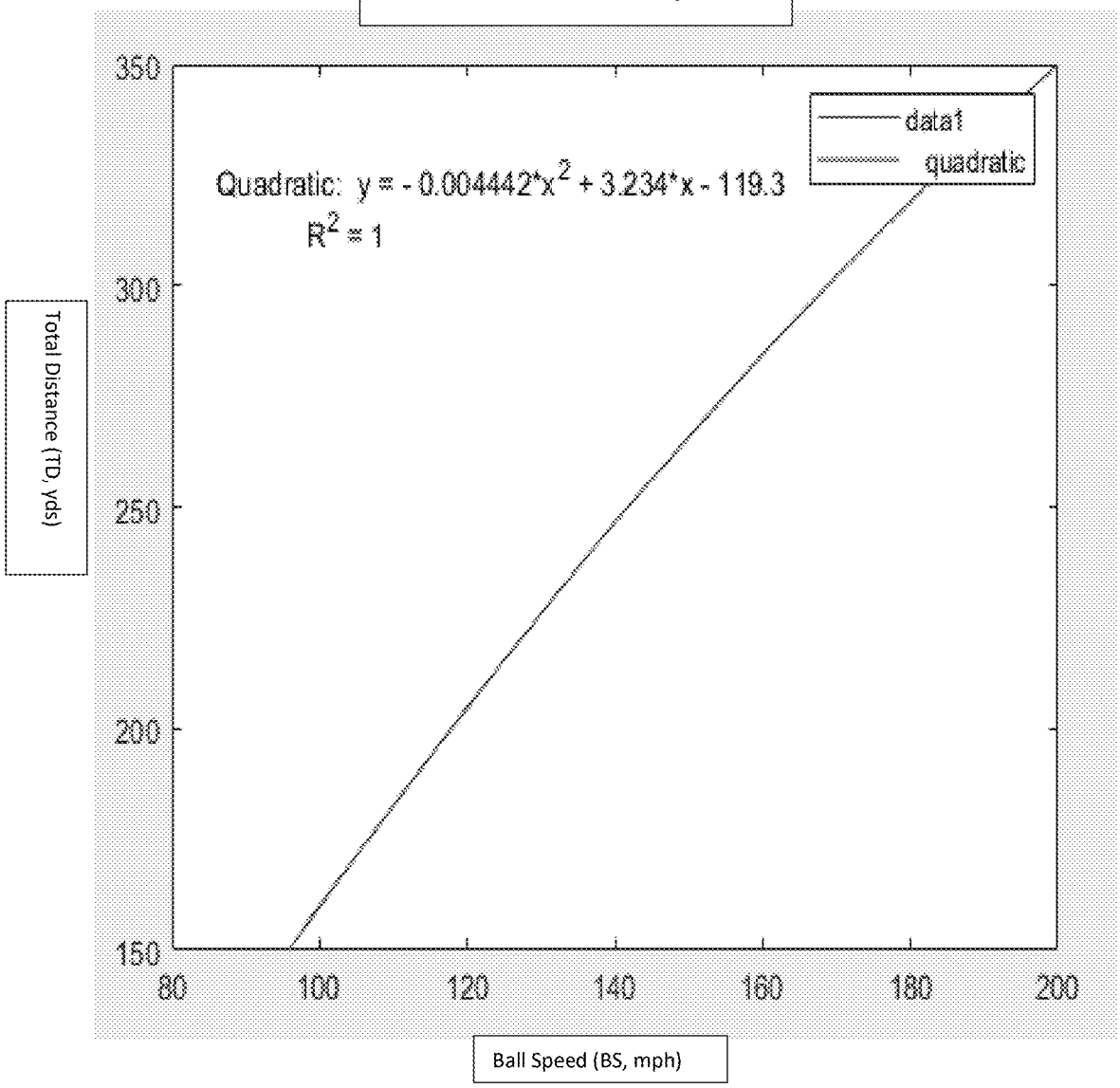
FIG. 1B is a graph of Total Distance (TD) vs Ball Speed (BS)

From a knowledge of how SP and LA varies as a function of ball speed (BS) described previously, where, $$\mathrm{SP(rpm)}=-4.7912*\mathrm{BS(mph)}+3414.3$$

$$\mathrm{LA(degs)}=-0.0579*\mathrm{BS(mph)}+20.259$$

in combination with the $C_L$ and $C_D$ values and their incorporation into the trajectory model (TM) which, in combination with the bounce and roll distance (using the correlation published by the United States Golf Association, R&A Rules Limited dated Mar. 16, 2021 entitled "Proposed Bounce Model for Use in Evaluating Optimum Overall Distance") allowed the total distance to be determined at different ball speeds to produce the best fit line graph shown in FIG. 1B. This yielded the quadratic equation below for calculated total distance, TD (yds) as a function of ball speed, BS (mph) as shown by the equation below:

$$\mathrm{TD}=-0.004442*\mathrm{BS}^2+3.234*\mathrm{BS}-119.3$$

Substitution of BS in this equation by PBS from the predicted ball speed equation;

$$\mathrm{PBS}=(-21.2+\mathrm{HS}*1.311)+(4.8+\mathrm{HS}*0.5231)*\mathrm{COR}_{143}+(0.06698-\mathrm{HS}*0.0008066)*\mathrm{CT}_{143}$$

allows the calculated total distance performance (TDC) at various headspeeds of golf balls to be determined over a range of $COR_{143}$, and $CT_{143}$ values and these data are summarized in Table 3.

$$\mathrm{TDC}=-0.004442*\mathrm{PBS}^2+3.234*\mathrm{PBS}-119.3$$

Analysis of the TDC data in Table 3 show that in general and as expected the TDC increases as head speed (HS) increases.

In order to show how the models predict the optimum characteristics of a ball that maintains TDC at the lower headspeeds of an amateur player (HS=80-100 mph) while losing distance at the higher headspeeds of a professional (HS=120, 123, 125 and 127 mph), a relative ratio (RR) was examined. $HS_y$ is a HS value in the range of 80-127 mph for the y value. As shown in Table 3, $TDC_x$ is the calculated value of TDC at each corresponding $HS_y$ value. This relative ratio examines the ratio of $TDC_x/HS_y$ across the full headspeed range of where x equals 80-127 mph divided by a reference TDC/HS at reference headspeeds of either 123, 125 or 127 mph (ie the reference TDC/HS can be $TDC_{123}/HS_{123}$, $TDC_{123}/HS_{125}$ or $TDC_{123}/HS_{127}$ respectively) to produce a so called Relative Ratio ($RR_{123}$, $RR_{125}$ or $RR_{127}$) of $(TDC_x/HS_y)/(TDC_{123}/HS_{123})$, $(TDC_x/HS_y)/(TDC_{125}/HS_{125})$ or $(TDC_x/HS_y)/(TDC_{127}/HS_{127})$respectively. The change in each relative ratio was then examined over the full headspeed range as a function of both ball $CT_{143}$ and ball $COR_{143}$. Table 3 and FIGS. 2-19 summarizes the calculated total distance (TDC) at various headspeeds of golf balls having a range of $COR_{143}$, and $CT_{143}$ values.

Thus, more specifically in reference to Table 3, for a golf ball having a $COR_{143}$ of 0.770 and a $CT_{143}$ value of 550, the $RR_{80/127}$ is 1.0264, the $RR_{80/125}$ is 1.0236, and the $RR_{80/123}$ is 1.0208. Similarly the $RR_{90/127}$ is 1.0302, the $RR_{90/125}$ is 1.0273 and the $RR_{90/123}$ is 1.0246.

TABLE 3

| Head Speed, $HS_y$, (mph) | $COR_{143}$ | $CT_{143}$ (μsec) | IV (ft/s) | PBS (mph) | SF | LA (deg) | SP (rpm) | $TDC_x$ (yds) | $TDC_x/HS_y$ Ratio | $TDC_x$/PBS Ratio | Relative Ratio $(TDC_x/HS_y)/(TDC_{127}/HS_{127})$ $RR_{127/127}$ | Relative Ratio $(TDC_x/HS_y)/(TDC_{125}/HS_{125})$ $RR_{127/125}$ | Relative Ratio $(TDC_x/HS_y)/(TDC_{123}/HS_{123})$ $RR_{127/123}$ |
|---|---|---|---|---|---|---|---|---|---|---|---|---|---|
| 127 | 0.720 | 450 | 243.5 | 180.6 | 1.422 | 9.80 | 2549 | 319.9 | 2.519 | 1.771 | 1.0000 | 0.9978 | 0.9958 |
| 127 | 0.720 | 550 | 245.4 | 177.1 | 1.394 | 10.01 | 2566 | 314.1 | 2.473 | 1.774 | 1.0000 | 0.9975 | 0.9950 |
| 127 | 0.720 | 650 | 247.3 | 173.5 | 1.366 | 10.21 | 2583 | 308.1 | 2.426 | 1.776 | 1.0000 | 0.9971 | 0.9942 |
| 127 | 0.770 | 450 | 250.3 | 184.2 | 1.450 | 9.59 | 2532 | 325.7 | 2.564 | 1.768 | 1.0000 | 0.9976 | 0.9953 |
| 127 | 0.770 | 550 | 252.2 | 180.6 | 1.422 | 9.80 | 2549 | 320.0 | 2.519 | 1.771 | 1.0000 | 0.9972 | 0.9946 |
| 127 | 0.770 | 650 | 254.1 | 177.1 | 1.394 | 10.00 | 2566 | 314.1 | 2.473 | 1.774 | 1.0000 | 0.9969 | 0.9938 |
| 127 | 0.820 | 450 | 257.1 | 187.8 | 1.478 | 9.39 | 2515 | 331.3 | 2.609 | 1.765 | 1.0000 | 0.9973 | 0.9948 |
| 127 | 0.820 | 550 | 259.0 | 184.2 | 1.450 | 9.59 | 2532 | 325.7 | 2.565 | 1.768 | 1.0000 | 0.9970 | 0.9942 |
| 127 | 0.820 | 650 | 260.9 | 180.7 | 1.423 | 9.80 | 2549 | 320.0 | 2.520 | 1.771 | 1.0000 | 0.9967 | 0.9934 |
| | | | | | | | | | | | $RR_{125/127}$ | $RR_{125/125}$ | $RR_{125/123}$ |
| 125 | 0.720 | 450 | 243.5 | 178.0 | 1.424 | 9.95 | 2562 | 315.6 | 2.525 | 1.773 | 1.0022 | 1.0000 | 0.9979 |
| 125 | 0.720 | 550 | 245.4 | 174.6 | 1.397 | 10.15 | 2578 | 309.9 | 2.479 | 1.775 | 1.0025 | 1.0000 | 0.9976 |
| 125 | 0.720 | 650 | 247.3 | 171.2 | 1.370 | 10.35 | 2594 | 304.2 | 2.433 | 1.777 | 1.0029 | 1.0000 | 0.9971 |
| 125 | 0.770 | 450 | 250.3 | 181.5 | 1.452 | 9.75 | 2545 | 321.3 | 2.571 | 1.770 | 1.0024 | 1.0000 | 0.9977 |
| 125 | 0.770 | 550 | 252.2 | 178.1 | 1.425 | 9.95 | 2561 | 315.8 | 2.526 | 1.773 | 1.0028 | 1.0000 | 0.9973 |
| 125 | 0.770 | 650 | 254.1 | 174.7 | 1.398 | 10.14 | 2577 | 310.1 | 2.481 | 1.775 | 1.0031 | 1.0000 | 0.9969 |
| 125 | 0.820 | 450 | 257.1 | 185.0 | 1.480 | 9.55 | 2528 | 327.0 | 2.616 | 1.767 | 1.0027 | 1.0000 | 0.9975 |
| 125 | 0.820 | 550 | 259.0 | 181.6 | 1.453 | 9.74 | 2544 | 321.5 | 2.572 | 1.770 | 1.0030 | 1.0000 | 0.9971 |
| 125 | 0.820 | 650 | 260.9 | 178.2 | 1.426 | 9.94 | 2560 | 316.0 | 2.528 | 1.773 | 1.0033 | 1.0000 | 0.9967 |
| | | | | | | | | | | | $RR_{123/127}$ | $RR_{123/125}$ | $RR_{123/123}$ |
| 123 | 0.720 | 450 | 243.5 | 175.3 | 1.425 | 10.11 | 2574 | 311.2 | 2.530 | 1.775 | 1.0043 | 1.0021 | 1.0000 |
| 123 | 0.720 | 550 | 245.4 | 172.1 | 1.399 | 10.29 | 2590 | 305.7 | 2.486 | 1.776 | 1.0050 | 1.0024 | 1.0000 |
| 123 | 0.720 | 650 | 247.3 | 168.9 | 1.373 | 10.48 | 2605 | 300.2 | 2.440 | 1.777 | 1.0058 | 1.0029 | 1.0000 |
| 123 | 0.770 | 450 | 250.3 | 178.8 | 1.454 | 9.91 | 2558 | 316.9 | 2.577 | 1.773 | 1.0047 | 1.0023 | 1.0000 |
| 123 | 0.770 | 550 | 252.2 | 175.6 | 1.427 | 10.09 | 2573 | 311.6 | 2.533 | 1.775 | 1.0054 | 1.0027 | 1.0000 |
| 123 | 0.770 | 650 | 254.1 | 172.3 | 1.401 | 10.28 | 2589 | 306.1 | 2.489 | 1.776 | 1.0062 | 1.0031 | 1.0000 |
| 123 | 0.820 | 450 | 257.1 | 182.2 | 1.482 | 9.71 | 2541 | 322.5 | 2.622 | 1.770 | 1.0052 | 1.0025 | 1.0000 |
| 123 | 0.820 | 550 | 259.0 | 179.0 | 1.455 | 9.89 | 2557 | 317.3 | 2.580 | 1.772 | 1.0059 | 1.0029 | 1.0000 |
| 123 | 0.820 | 650 | 260.9 | 175.8 | 1.429 | 10.08 | 2572 | 312.0 | 2.536 | 1.774 | 1.0066 | 1.0033 | 1.0000 |
| | | | | | | | | | | | $RR_{120/127}$ | $RR_{120/125}$ | $RR_{120/123}$ |
| 120 | 0.720 | 450 | 243.5 | 171.4 | 1.428 | 10.34 | 2593 | 304.4 | 2.537 | 1.777 | 1.0071 | 1.0049 | 1.0028 |
| 120 | 0.720 | 550 | 245.4 | 168.4 | 1.403 | 10.51 | 2608 | 299.3 | 2.494 | 1.778 | 1.0085 | 1.0059 | 1.0035 |
| 120 | 0.720 | 650 | 247.3 | 165.4 | 1.378 | 10.68 | 2622 | 294.1 | 2.451 | 1.778 | 1.0100 | 1.0070 | 1.0042 |
| 120 | 0.770 | 450 | 250.3 | 174.7 | 1.456 | 10.14 | 2577 | 310.2 | 2.585 | 1.775 | 1.0079 | 1.0055 | 1.0032 |
| 120 | 0.770 | 550 | 252.2 | 171.8 | 1.431 | 10.31 | 2591 | 305.1 | 2.543 | 1.776 | 1.0093 | 1.0065 | 1.0038 |
| 120 | 0.770 | 650 | 254.1 | 168.8 | 1.406 | 10.49 | 2606 | 300.0 | 2.500 | 1.777 | 1.0107 | 1.0075 | 1.0045 |
| 120 | 0.820 | 450 | 257.1 | 178.1 | 1.484 | 9.95 | 2561 | 315.8 | 2.632 | 1.773 | 1.0088 | 1.0061 | 1.0036 |
| 120 | 0.820 | 550 | 259.0 | 175.1 | 1.459 | 10.12 | 2575 | 310.8 | 2.590 | 1.775 | 1.0100 | 1.0070 | 1.0041 |
| 120 | 0.820 | 650 | 260.9 | 172.2 | 1.435 | 10.29 | 2589 | 305.8 | 2.548 | 1.776 | 1.0114 | 1.0081 | 1.0048 |
| | | | | | | | | | | | $RR_{100/127}$ | $RR_{100/125}$ | $RR_{100/123}$ |
| 100 | 0.720 | 450 | 243.5 | 144.9 | 1.449 | 11.87 | 2720 | 256.0 | 2.560 | 1.767 | 1.0161 | 1.0139 | 1.0118 |
| 100 | 0.720 | 550 | 245.4 | 143.5 | 1.435 | 11.95 | 2727 | 253.3 | 2.533 | 1.765 | 1.0242 | 1.0216 | 1.0191 |
| 100 | 0.720 | 650 | 247.3 | 142.1 | 1.421 | 12.03 | 2733 | 250.6 | 2.506 | 1.763 | 1.0329 | 1.0298 | 1.0269 |
| 100 | 0.770 | 450 | 250.3 | 147.7 | 1.477 | 11.71 | 2707 | 261.5 | 2.615 | 1.770 | 1.0197 | 1.0173 | 1.0149 |
| 100 | 0.770 | 550 | 252.2 | 146.4 | 1.464 | 11.79 | 2713 | 258.9 | 2.589 | 1.769 | 1.0275 | 1.0247 | 1.0219 |
| 100 | 0.770 | 650 | 254.1 | 145.0 | 1.450 | 11.86 | 2720 | 256.2 | 2.562 | 1.767 | 1.0358 | 1.0326 | 1.0294 |
| 100 | 0.820 | 450 | 257.1 | 150.6 | 1.506 | 11.54 | 2693 | 266.9 | 2.669 | 1.773 | 1.0233 | 1.0206 | 1.0180 |
| 100 | 0.820 | 550 | 259.0 | 149.2 | 1.492 | 11.62 | 2699 | 264.3 | 2.643 | 1.772 | 1.0308 | 1.0277 | 1.0247 |
| 100 | 0.820 | 650 | 260.9 | 147.8 | 1.478 | 11.70 | 2706 | 261.7 | 2.617 | 1.770 | 1.0388 | 1.0353 | 1.0320 |
| | | | | | | | | | | | $RR_{90/127}$ | $RR_{90/125}$ | $RR_{90/123}$ |
| 90 | 0.720 | 450 | 243.5 | 131.6 | 1.462 | 12.64 | 2784 | 229.4 | 2.549 | 1.743 | 1.0118 | 1.0096 | 1.0075 |
| 90 | 0.720 | 550 | 245.4 | 131.1 | 1.456 | 12.67 | 2786 | 228.2 | 2.536 | 1.742 | 1.0254 | 1.0228 | 1.0203 |
| 90 | 0.720 | 650 | 247.3 | 130.5 | 1.450 | 12.70 | 2789 | 227.1 | 2.523 | 1.740 | 1.0399 | 1.0368 | 1.0338 |
| 90 | 0.770 | 450 | 250.3 | 134.2 | 1.491 | 12.49 | 2771 | 234.7 | 2.608 | 1.749 | 1.0170 | 1.0146 | 1.0122 |
| 90 | 0.770 | 550 | 252.2 | 133.6 | 1.485 | 12.52 | 2774 | 233.6 | 2.595 | 1.748 | 1.0302 | 1.0273 | 1.0246 |
| 90 | 0.770 | 650 | 254.1 | 133.1 | 1.479 | 12.55 | 2777 | 232.4 | 2.583 | 1.746 | 1.0441 | 1.0409 | 1.0377 |
| 90 | 0.820 | 450 | 257.1 | 136.8 | 1.520 | 12.34 | 2759 | 240.0 | 2.667 | 1.754 | 1.0222 | 1.0195 | 1.0169 |
| 90 | 0.820 | 550 | 259.0 | 136.2 | 1.514 | 12.37 | 2762 | 238.9 | 2.654 | 1.753 | 1.0349 | 1.0318 | 1.0288 |
| 90 | 0.820 | 650 | 260.9 | 135.7 | 1.508 | 12.40 | 2764 | 237.7 | 2.641 | 1.752 | 1.0484 | 1.0449 | 1.0415 |
| | | | | | | | | | | | $RR_{80/127}$ | $RR_{80/125}$ | $RR_{80/123}$ |
| 80 | 0.720 | 450 | 243.5 | 118.4 | 1.480 | 13.41 | 2847 | 201.3 | 2.516 | 1.700 | 0.9987 | 0.9965 | 0.9945 |
| 80 | 0.720 | 550 | 245.4 | 118.6 | 1.483 | 13.39 | 2846 | 201.8 | 2.523 | 1.701 | 1.0200 | 1.0174 | 1.0149 |
| 80 | 0.720 | 650 | 247.3 | 118.9 | 1.486 | 13.38 | 2845 | 202.3 | 2.529 | 1.702 | 1.0424 | 1.0393 | 1.0364 |
| 80 | 0.770 | 450 | 250.3 | 120.7 | 1.509 | 13.27 | 2836 | 206.3 | 2.579 | 1.709 | 1.0058 | 1.0033 | 1.0010 |
| 80 | 0.770 | 550 | 252.2 | 120.9 | 1.512 | 13.26 | 2835 | 206.9 | 2.586 | 1.710 | 1.0264 | 1.0236 | 1.0208 |
| 80 | 0.770 | 650 | 254.1 | 121.2 | 1.515 | 13.24 | 2834 | 207.4 | 2.592 | 1.711 | 1.0481 | 1.0449 | 1.0417 |
| 80 | 0.820 | 450 | 257.1 | 123.0 | 1.538 | 13.14 | 2825 | 211.4 | 2.642 | 1.718 | 1.0127 | 1.0100 | 1.0075 |
| 80 | 0.820 | 550 | 259.0 | 123.3 | 1.541 | 13.12 | 2824 | 211.9 | 2.648 | 1.719 | 1.0327 | 1.0296 | 1.0267 |
| 80 | 0.820 | 650 | 260.9 | 123.5 | 1.544 | 13.11 | 2822 | 212.4 | 2.655 | 1.720 | 1.0538 | 1.0503 | 1.0469 |

For comparison purposes a number of commerically available golf balls (Comparative Examples 1-16) were tested and their $COR_{143}$, $CT_{143}$ measured and their IV, PBS and TDC values calculated as shown in Table 4. Table 5 illustrates the corresponding calculated values of $RR_{80/127}$, $RR_{80/125}$, $RR_{80/123}$, $RR_{90/127}$, $RR_{90/125}$ or $RR_{90/123}$.

TABLE 4

| Comp. Ex No. | Ball Construction | $COR_{143}$ | $CT_{143}$ (μsec) | IV (ft/s) | $PBS_{80}$ (mph) | $PBS_{90}$ (mph) | $PBS_{123}$ (mph) | $PBS_{125}$ mph) | $PBS_{127}$ (mph) | $TDC_{80}$ (yd) | $TDC_{90}$ (yd) | $TDC_{123}$ (yd) | $TDC_{125}$ (yd) | $TDC_{127}$ (yd) |
|---|---|---|---|---|---|---|---|---|---|---|---|---|---|---|
| 1 | 2-piece[a] | 0.744€ | 617 | 250.0 | 119.9 | 131.9 | 171.6 | 174.0 | 176.4 | 204.6 | 230.0 | 304.9 | 309.0 | 313.0 |
| 2 | 2-piece[a] | 0.767 | 579 | 252.3 | 120.9 | 133.3 | 174.4 | 176.9 | 179.4 | 206.7 | 232.9 | 309.6 | 313.8 | 317.9 |
| 3 | 2-piece[a] | 0.768 | 568 | 252.2 | 120.9 | 133.4 | 174.8 | 177.3 | 179.8 | 206.7 | 233.1 | 310.3 | 314.5 | 318.6 |
| 4 | 2-piece[a] | 0.768 | 560 | 252.1 | 120.9 | 133.5 | 175.1 | 177.6 | 180.2 | 206.7 | 233.3 | 310.8 | 315.0 | 319.2 |
| 5 | 2-piece[a] | 0.762 | 560 | 251.8 | 120.6 | 133.2 | 174.7 | 177.2 | 179.7 | 206.1 | 232.6 | 310.1 | 314.3 | 318.4 |
| 6 | 3-piece[b] | 0.779 | 518 | 252.8 | 121.3 | 134.3 | 177.2 | 179.8 | 182.4 | 207.6 | 234.9 | 314.3 | 318.6 | 322.8 |
| 7 | 3-piece[b] | 0.782 | 488 | 252.7 | 121.4 | 134.6 | 178.4 | 181.1 | 183.7 | 207.8 | 235.6 | 316.3 | 320.6 | 324.9 |
| 8 | 3-piece[b] | 0.789 | 469 | 253.2 | 121.6 | 135.1 | 179.5 | 182.2 | 184.9 | 208.3 | 236.5 | 318.0 | 322.4 | 326.7 |
| 9 | 3-piece[b] | 0.788 | 460 | 253.0 | 121.6 | 135.1 | 179.7 | 182.4 | 185.1 | 208.2 | 236.5 | 318.4 | 322.8 | 327.2 |
| 10 | 3-piece[b] | 0.783 | 462 | 252.3 | 121.3 | 134.8 | 179.3 | 182.0 | 184.7 | 207.7 | 235.9 | 317.7 | 322.1 | 326.4 |
| 11 | 3-piece[b] | 0.788 | 445 | 253.0 | 121.5 | 135.2 | 180.2 | 182.9 | 185.7 | 208.2 | 236.7 | 319.2 | 323.7 | 328.0 |
| 12 | 3-piece[b] | 0.794 | 441 | 253.5 | 121.8 | 135.5 | 180.8 | 183.5 | 186.3 | 208.7 | 237.4 | 320.2 | 324.6 | 329.0 |
| 13 | 3-piece[b] | 0.798 | 431 | 253.8 | 122.0 | 135.8 | 181.4 | 184.1 | 186.9 | 209.1 | 237.9 | 321.1 | 325.6 | 329.9 |
| 14 | 3-piece[b] | 0.792 | 432 | 253.0 | 121.7 | 135.5 | 180.9 | 183.6 | 186.4 | 208.5 | 237.3 | 320.3 | 324.8 | 329.2 |
| 15 | 4-piece[c] | 0.792 | 431 | 253.0 | 121.7 | 135.5 | 180.9 | 183.7 | 186.4 | 208.5 | 237.3 | 320.4 | 324.9 | 329.2 |
| 16 | 4-piece[d] | 0.789 | 430 | 252.6 | 121.5 | 135.3 | 180.7 | 183.5 | 186.2 | 208.1 | 236.9 | 320.0 | 324.5 | 328.9 |

[a]unitary core plus outer cover layer
[b]unitary core plus intermediate layer plus outer cover layer
[c]unitary core plus two intermediate layers plus outer cover layer
[d]dual core plus intermediate layer plus outer cover layer
[e]$COR_{125}$ = 0.778

TABLE 5

| Comparative Ex No. | $COR_{143}$ | $CT_{143}$ (μsec) | IV (ft/s) | $RR_{80/127}$ | $RR_{80/125}$ | $RR_{80/123}$ | $RR_{90/127}$ | $RR_{90/125}$ | $RR_{90/123}$ |
|---|---|---|---|---|---|---|---|---|---|
| 1 | 0.744[e] | 617 | 250.0 | 1.038 | 1.035 | 1.032 | 1.037 | 1.034 | 1.031 |
| 2 | 0.767 | 579 | 252.3 | 1.032 | 1.029 | 1.026 | 1.034 | 1.031 | 1.028 |
| 3 | 0.768 | 568 | 252.2 | 1.030 | 1.027 | 1.024 | 1.032 | 1.030 | 1.027 |
| 4 | 0.768 | 560 | 252.1 | 1.028 | 1.025 | 1.023 | 1.031 | 1.028 | 1.026 |
| 5 | 0.762 | 560 | 251.8 | 1.028 | 1.025 | 1.022 | 1.031 | 1.028 | 1.025 |
| 6 | 0.779 | 518 | 252.8 | 1.021 | 1.018 | 1.016 | 1.027 | 1.024 | 1.021 |
| 7 | 0.782 | 488 | 252.7 | 1.015 | 1.012 | 1.010 | 1.023 | 1.020 | 1.018 |
| 8 | 0.789 | 469 | 253.2 | 1.012 | 1.009 | 1.007 | 1.021 | 1.019 | 1.016 |
| 9 | 0.788 | 460 | 253.0 | 1.010 | 1.008 | 1.005 | 1.020 | 1.018 | 1.015 |
| 10 | 0.783 | 462 | 252.3 | 1.010 | 1.007 | 1.005 | 1.020 | 1.017 | 1.015 |
| 11 | 0.788 | 445 | 253.0 | 1.007 | 1.005 | 1.003 | 1.018 | 1.016 | 1.013 |
| 12 | 0.794 | 441 | 253.5 | 1.007 | 1.005 | 1.002 | 1.018 | 1.016 | 1.013 |
| 13 | 0.798 | 431 | 253.8 | 1.006 | 1.004 | 1.001 | 1.018 | 1.015 | 1.013 |
| 14 | 0.792 | 432 | 253.0 | 1.005 | 1.003 | 1.000 | 1.017 | 1.015 | 1.012 |
| 15 | 0.792 | 431 | 253.0 | 1.005 | 1.003 | 1.000 | 1.017 | 1.014 | 1.012 |
| 16 | 0.789 | 430 | 252.6 | 1.005 | 1.002 | 1.000 | 1.017 | 1.014 | 1.012 |

[e]$COR_{125}$ = 0.778

As shown in Tables 4 and 5, the $COR_{125}$ of the Comparative Example No. 1 was also measured as 0.778 but measured as 0.744 for $COR_{143}$. Typical golf bails which are optimized for high distance across a range of headspeeds would thus exhibit a profile in which the relative ratio RR would exhibit an almost linear response across the range of HS, whereas the ideal profile of the golf balls of the present invention would show an increase in the relative ratio as the headspeed is drops below 100 mph.

Analysis of the data in Table 3 and FIG. 2 using the relative ratio for 123 mph headspeed ($RR_{123}$) shows that in general the model predicts that for a $COR_{143}$ value of 0.72, golf balls having a higher $CT_{143}$ of 650 msecs typically retain or show an increase in the relative distance generated at the high driver speed of 123 mph than at the lower headspeeds as compared to that of a ball of lower $CT_{143}$. This effect becomes more pronounced as shown in FIGS. 3 and 4 as the $COR_{143}$ value is increased through 0.77 (FIG. 3) to 0.82 (FIG. 4).

Similarly, analysis of the data in Table 3 and FIG. 5 again using the relative ratio for 123 mph headspeed ($RR_{123}$) shows that in general the model predicts that for a $CT_{143}$ of 450 μsecs, golf balls having a higher $COR_{143}$ value of 0.82 typically retain or show an increase in the relative distance generated at the high driver speed of 123 mph than at the lower headspeeds as compared to that of a ball of lower COR. This effect becomes more pronounced as shown in FIGS. 6 and 7 as the $CT_{143}$ value is increased through 550 microsecs (FIG. 6) to 650 microsecs (FIG. 7). Similar trends are observed in FIGS. 8-13 for $RR_{125}$ and FIGS. 14-19 for $RR_{127}$.

In addition, analysis of the data in Table 3 and FIGS. 2-19 demonstrate that for balls in the low $CT_{143}$ region of 450 microsecs, the drop off in distance is quite pronounced below 90 mph headspeed and is quite pronounced for balls across the whole $COR_{143}$ range examined as the shapes of the profiles are quite similar for balls of $COR_{143}$ of 0.72, 0.77 and 0.82. This effect is less pronounced for balls having a higher $CT_{143}$ as shown by the profiles with less drop of in relative distance at the lower speeds for each $COR_{143}$ range examined and this trend is also continued as the $CT_{143}$ is increased with the profiles showing less drop off at lower speeds for all three $COR_{143}$ values examined.

Thus, based on these predictions there is an optimum range of ball properties which would allow the design of a golf ball which exhibits reduced distance at the high driver swing speeds generated by professional golfers but also much less of a distance loss, when the same ball is hit at the lower swing speeds of 80-90 mph generated by the recreational golfer. Based on the analysis of these data the following optimum ranges of properties were determined.

More generally, the $COR_{125}$ of the golf balls of the present invention is greater than about 0.760, preferably greater than about 0.780, more preferably greater than 0.790, most preferably greater than 0.795, and especially greater than 0.800 when measured at 125 ft/sec outbound velocity. More specifically, the $COR_{125}$ of the golf balls of the present invention is from about 0.760 to about 0.850, preferably from about 0.770 to about 0.840

The $COR_{143}$ of the golf balls of the present invention is greater than or equal to 0.720, preferably greater than about 0.750, more preferably greater than about 0.780, even more preferably greater than about 0.790 and most preferably greater than about 0.840 when measured at 143 ft/sec velocity.

The Contact Time, $CT_{143}$ of the golf balls of the present invention is greater than or equal to 400 microsecs, preferably greater than or equal to 500 microsecs, even more preferably greater than or equal to 550 microsecs and most preferably greater than or equal to 650 microsecs when measured at 143 ft/sec velocity.

The Initial Velocity of the golf balls of the present invention greater than about 253 ft/sec, preferably greater than about 253.5 ft/sec, more preferably greater than about 255 ft/sec.

Typically, the dimple patterns used on the golf balls of the present invention when tested under the USGA Screening Conditions have a minimum Coefficient of lift ($C_L$) from about 0.120 to about 0.128, preferably from about 0.121 to about 0.127, more preferably from about 0.122 to about 0.126 and a maximum Coefficient of lift ($C_L$) from about 0.265 to about 0.295, preferably from about 0.270 to about 0.290, more preferably from about 0.275 to about 0.285.

The dimple patterns used on the golf balls of the present invention when tested under the USGA Screening Conditions also have a minimum Coefficient of drag ($C_D$) from about 0.195 to about 0.230, preferably from about 0.200 to about 0.225, more preferably from about 0.210 to about 0.220 and a maximum Coefficient of drag ($C_D$) from about 0.290 to about 0.340, preferably from about 0.300 to about 0.330, more preferably from about 0.310 to about 0.320.

The golf balls also have a relative ratio, $RR_{80/123}$, (where $RR_{80/123}=TDC_{80}/HS_{80})/[(TDC_{123}/HS_{123})]$) of greater than or equal to 1.01, preferably greater than or equal to 1.03, more preferably greater than or equal to 1.04, even more preferably greater than or equal to 1.05 at a HS of 80 mph.

The golf balls also have a relative ratio, $RR_{90/123}$, (where $RR_{90/123}=TDC_{90}/HS_{90})/[(TDC_{123}/HS_{123})]$) of greater than or equal to 1.03 at a HS of 90 mph.

The golf balls also have a relative ratio, $RR_{80/125}$, (where $RR_{80/125}=TDC_{80}/HS_{80})/[(TDC_{125}/HS_{125})]$) of greater than or equal to 1.01, preferably greater than or equal to 1.03, more preferably greater than or equal to 1.04, even more preferably greater than or equal to 1.05 at a HS of 80 mph.

The golf balls also have a relative ratio, $RR_{90/125}$, (where $RR_{90/125}=TDC_{90}/HS_{90})/[(TDC_{125}/HS_{125})]$) of greater than or equal to 1.03 at a HS of 90 mph.

The golf balls also have a relative ratio, $RR_{80/127}$, (where $RR_{80/127}=TDC_{80}/HS_{80})/[(TDC_{127}/HS_{127})]$) of greater than or equal to about 1.01, preferably greater than or equal to about 1.03, more preferably greater than or equal to 1.04, even more preferably greater than or equal to 1.05 at a HS of 80 mph.

The golf balls also have a relative ratio, $RR_{90/127}$, (where $RR_{90/127}=TDC_{90}/HS_{90})/[(TDC_{127}/HS_{127})]$) of greater than or equal to 1.03 at a HS of 90 mph.

The distance performance of the golf balls of the present invention can also be determined under similar robot testing conditions to those of the USGA standard test, (the full protocol of which is publicly available as published by the R&A Rules Limited and United States Golf Association named "Overall Distance Standard and Symmetry Test Protocol TPX3006 Rev. 3.0 9 April 2019") for carry distance, with the modifications described below as Test Conditions 0 through 4.

The following test conditions are applied in a robot test condition similar to the USGA test while varying parameters such as club head speed, spin, and launch angle.

Test Condition 0

The golf balls carry distance is predicted assuming the same conditions as the USGA standard test for carry distance, with the initial robot set up at a clubhead speed of 120±0.5 mph (HS0) while and a launch angle of 10±0.5 degrees and a spin rate of 2,520±120 rpm. The bounce and roll distance may be determined using the equation;

$$y=-0.9774\alpha+55.568$$

where y is the bounce and roll distance in yards and $\alpha$ is the terminal or landing angle of the ball. The golf balls measured total distance ("TD0") under Test Condition 0 is a summation of the carry distance and the bounce and roll distance.

Test Condition 1

The golf balls carry distance is predicted assuming the same conditions as the USGA standard test for carry distance, but the initial robot set up changed from a clubhead speed of 120 mph to a speed of 125±0.5 mph (HS1) while maintaining the tests launch angle of 10±0.5 degrees and a spin rate of 2,520±120 rpm. The bounce and roll distance may be determined using the equation;

$$y=-0.9774\alpha+55.568$$

where y is the bounce and roll distance in yards and $\alpha$ is the terminal or landing angle of the ball. The golf balls measured total distance ("TD1") under Test Condition 1 is a summation of the carry distance and the bounce and roll distance.

Test Condition 2

The golf balls carry distance may also be measured assuming the same conditions as the USGA standard test for carry distance, but the initial robot set up changed from a clubhead speed of 120 mph to a speed of 80±0.5 mph (HS2) and a launch angle of 13±0.5 degrees and a spin rate of 2,800±120 rpm.

The bounce and roll distance may again calculated using the equation;

$$y=-0.9774\alpha+55.568 \text{ or}$$

where y is the bounce and roll distance in yards and α is the terminal or landing angle of the ball.

The golf balls measured total distance ("TD2") under Test Condition 2 is a summation of the carry distance and the bounce and roll distance.

Test Condition 3

The golf balls carry distance is predicted assuming the same conditions as the USGA standard test for carry distance, but the initial robot set up changed from a clubhead speed of 120 mph to a speed of 127±0.5 mph (HS3) and a launch angle of 11±0.5 degrees and a spin rate of 2,220±120 rpm. The bounce and roll distance may be determined using the equation;

$$y=-0.9774\alpha+55.568$$

where y is the bounce and roll distance in yards and α is the terminal or landing angle of the ball.

The golf balls measured total distance ("TD3") under Test Condition 3 is a summation of the carry distance and the bounce and roll distance.

Test Condition 4

The golf balls carry distance is predicted assuming the same conditions as the USGA standard test for carry distance, but the initial robot set up changed from a clubhead speed of 120 mph to a speed of 127±0.5 mph (HS4) and changing the tests launch angle to 12±0.5 degrees and a spin rate of 1920±120 rpm. The bounce and roll distance may be determined using the equation;

$$y=-0.9774\alpha+55.568$$

where y is the bounce and roll distance in yards and α is the terminal or landing angle of the ball. The golf balls measured total distance ("TD4") under Test Condition 4 is a summation of the carry distance and the bounce and roll distance.

Under these robot testing conditions, the golf balls of the present invention have a total distance TD0-TD4 of from about 310 to about 320 yards when measured under Test Conditions 0-4.

The golf balls also have a total distance TD2 vs. Headspeed ratio of greater than about 2.5 when measured under Test Condition 2. As used herein, the term "vs." is describing a ratio where TD2 vs. Headspeed is a ratio of TD divided by Headspeed (TD/Headspeed). In some embodiments, the TD2 vs. Headspeed ratio is greater than 2.0, greater than 2.25, greater than 2.75 or greater than 3.0.

The golf balls also have and a TD0-4 vs Ballspeed ratio of greater than or equal to 1.70, preferably greater than or equal to 1.75, more preferably greater than or equal to 1.80 and even more preferably greater than or equal to 1.85 as measured under Test Conditions 0-4.

Example 1—Dimple Pattern

The golf balls of the present invention exhibit the claimed ranges of $COR_{143}$, $CT_{143}$ and $RR_{80/123}$, $RR_{90/123}$, $RR_{80/125}$, $RR_{90/125}$, $RR_{80/127}$ or $RR_{90/127}$.

One exemplary dimple pattern may be laid out by assuming the spherical surface of a golf ball is like the globe, thus the golf ball 30 has an equator 32, and a North pole 34 and a South pole, 36.

The spherical surface of the ball is partitioned initially into subunits formed by projection of a polygonal configuration on each hemisphere of the golf ball and placing the dimples with reference to the lines and faces of this projection. In the current embodiment, a polygonal configuration known as a pentagonal pyramid is projected onto the surface of each hemisphere. of the ball, when viewed in a cross seam orientation, with each hemisphere connected by their bases. A pentagonal pyramid is a pyramid with a pentagonal base upon which are erected five equilateral triangular faces, with one of the five triangles having vertices at the pole 34, and at point 38 and 40 as shown in FIG. 20A.

A coordinate system may then be set up on the surface of the sphere in which passage over the surface of the ball from the pole 34 in the northern hemisphere to pole 36 in the other hemisphere along the line 42 which is the edge of the spherical triangle, where all points on this line have a coordinate theta (θ) of 0 degrees and a coordinate phi (ϕ) from 0 degrees at pole 34 in the through a coordinate phi (ϕ) to 90 degrees (at point 38) to a coordinate phi (ϕ) of 180 degrees at pole 36.

Similarly passage over the surface of the ball laterally along the equator 32 of the ball, all points on the equator have a coordinate phi (ϕ) of 90 degrees and a coordinate theta (θ) from 0 degrees along line 42. through a coordinate theta (θ) of 36 degrees along dashed line 44, and further through a coordinate theta (θ) 72 degrees along line 42 and so on around the ball to one full passage around the equator at a coordinate theta of 360 degrees.

Figure 20A:
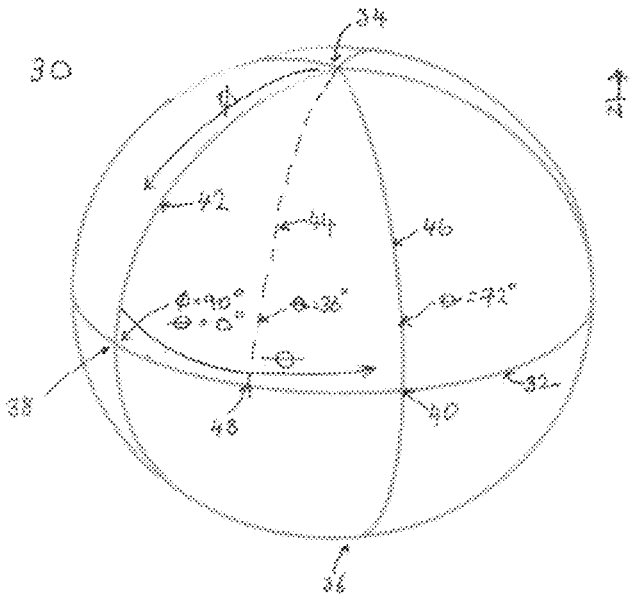
FIG. 20A illustrates an equatorial view of the outer surface of a golf ball with a pentagonal pyramid projected on its surface and the coordinate system used to locate the position of the dimple centers.

Dimples are placed into each of the five repeating spherical triangles of the pentagonal pyramid such that the pattern within each is symmetrical about the mirror plane of dashed line 44 passing through the pole 34 and the geometric center of the spherical triangle to the midpoint of the base point 48 as shown in FIG. 20A. The pattern of the dimples which lie on or within the edges of the triangle having vertices at point 34, 38 and 48 thus represent the minimum repeating pattern. Thus, the pattern within the five spherical triangles is copied every 72 degrees within each hemisphere, given the pentagonal bipyramid projection upon which it as based, and the pattern within the minimum repeating pattern is copied every 36 degrees within each hemisphere.

Figure 20B:
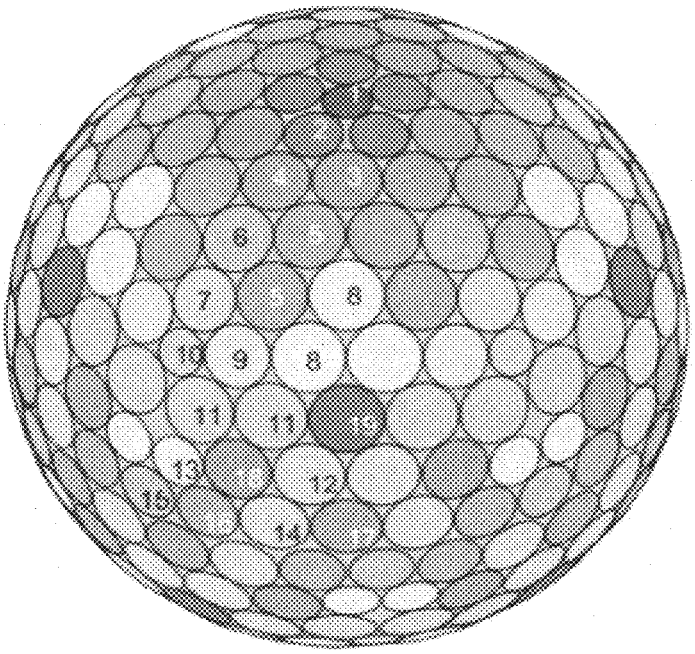
FIG. 20B is an equatorial view of the outer surface of a golf ball showing how dimples are distributed within the minimum repeating unit of a spherical triangle of the projection of a pentagonal bipyramid on its surface.

FIG. 20B shows the placement of the dimples within the minimum repeating pattern with the dimple numbers and their coordinates and diameters corresponding to the dimples summarized in Table 6.

TABLE 6

| Dimple # | Phi (ϕ, deg) | Theta (ϑ, deg) | Diameter (d2, mm) | Depth (ht, mm) | Radius Inner (R1, mm) | Radius Outer (R2, mm) | Alpha (α) |
|---|---|---|---|---|---|---|---|
| 1 | 0 | 0 | 3.2 | 0.096 | 18.0744 | 7.5045 | 0.5 |
| 2 | 9.4856 | 0 | 3.75 | 0.113 | 21.1875 | 8.7949 | 0.5 |
| 3 | 17.4928 | 36 | 4.45 | 0.134 | 25.1481 | 10.4108 | 0.5 |
| 4 | 20.8183 | 0 | 4.4 | 0.132 | 24.8544 | 10.3215 | 0.5 |
| 5-1 | 40.9326 | 16.4424 | 4.55 | 0.159 | 22.1872 | 9.1970 | 0.5 |

TABLE 6-continued

| Dimple # | Phi (ϕ, deg) | Theta (ϑ, deg) | Diameter (d2, mm) | Depth (ht, mm) | Radius Inner (R1, mm) | Radius Outer (R2, mm) | Alpha (α) |
|---|---|---|---|---|---|---|---|
| 5-2 | 28.7761 | 22.9259 | 4.55 | 0.159 | 22.1872 | 9.1970 | 0.5 |
| 6 | 33.1921 | 0 | 4.65 | 0.162 | 22.6709 | 9.4186 | 0.5 |
| 7 | 45.5018 | 0 | 4.35 | 0.152 | 21.2074 | 8.8082 | 0.5 |
| 8-1 | 50.742 | 27.6439 | 4.75 | 0.166 | 23.1670 | 9.6136 | 0.5 |
| 8-2 | 39.196 | 36 | 4.75 | 0.166 | 23.1670 | 9.6136 | 0.5 |
| 9 | 52.9222 | 12.1782 | 4.3 | 0.150 | 20.9718 | 8.7162 | 0.5 |
| 10 | 55.8723 | 0 | 3.25 | 0.113 | 15.8498 | 6.5762 | 0.5 |
| 11-1 | 64.6993 | 7.2879 | 4.7 | 0.155 | 24.1958 | 10.0230 | 0.5 |
| 11-2 | 62.5041 | 21.4242 | 4.7 | 0.155 | 24.1958 | 10.0230 | 0.5 |
| 12 | 72.9324 | 29.4098 | 4.6 | 0.170 | 21.1780 | 8.7886 | 0.5 |
| 13 | 76.0149 | 5.2564 | 3.65 | 0.135 | 16.8099 | 6.9871 | 0.5 |
| 14 | 83.9788 | 23.6946 | 4.5 | 0.173 | 19.9706 | 8.2735 | 0.5 |
| 15 | 85.3552 | 0 | 4.1 | 0.157 | 18.1932 | 7.5535 | 0.5 |
| 16 | 84.8994 | 11.758 | 4.2 | 0.161 | 18.6427 | 7.7314 | 0.5 |
| 17 | 83.787 | 36 | 4.5 | 0.173 | 19.9706 | 8.2735 | 0.5 |
| 18 | 74.0033 | 16.4776 | 4.4 | 0.163 | 20.2573 | 8.4008 | 0.5 |
| 19 | 61.706 | 36 | 4.75 | 0.157 | 24.4574 | 10.1625 | 0.5 |

In a more preferred embodiment, the pattern in the lower hemisphere is a copy of the upper but rotated from about 10 to about 30 deg about the pole axis using the so-called right-hand rule to indicate the direction of this rotation. In this method, the thumb of the right hand is pointed down the pole axis in a North to South orientation and the curl of the fingers indicates the direction of displacement of the southern hemisphere relative to the north. This would appear as a clockwise direction if viewed above and down the pole axis such that the coordinates of this dimples in the minimum repeating pattern of this so called modified pentagonal bipyramid projection are such that the values of theta in the southern hemisphere are translated 30 degrees around the pole axis in a westerly direction relative to their counterparts in the northern hemisphere of the ball.

Figure 21:
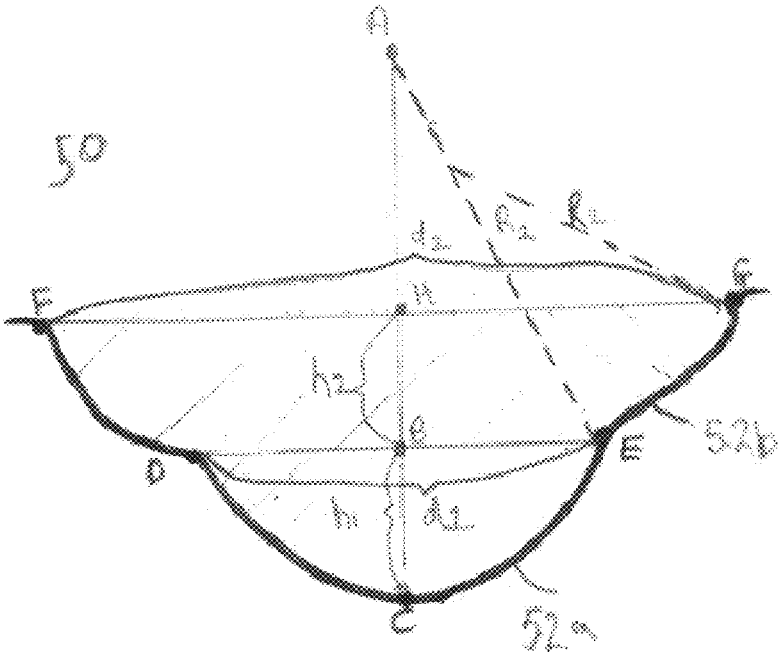
FIG. 21 is a cross-sectional view explaining the specifics of a dual radius dimple.

Although traditional circular dimples in which one radius defines its profile may be employed, in a preferred embodiment, dual radius dimples, in which two radii are used to describe the shape of the dimple profile 40 are placed on the golf balls surface, a cross section of which is shown in FIG. 21. In a dual radius dimple, a radius ($R_1$) describes the bottom of the dimple i.e. it describes the shape of the lower dimple profile, and a radius ($R_2$) describes the shape of the dimple about its circumference.

The dimple diameter ($d_2$) represents the diameter at the open end of the dual radius dimple, or the distance between both contact points F and G of a common tangent connected between both left hand and right hand opening edges of each of the dimple 50, i.e., the distance F-G in FIG. 21. In the dual radius dimple 50, the diameter ($d_1$) is represented by the distance between both left hand and right hand transition points D and E located at the boundary of the curvature $R_1$ of the bottom wall portion 52*a* and the curvature $R_2$ of the peripheral wall portion 52*b*, i.e., the distance D-E in FIG. 21.

For the dual radius dimples used in the present invention the relations between the diameters ($d_1$) and ($d_2$) are set to a relative ratio, α, according to the following equation, $$\alpha = d_1/d_2$$

For the dual radius dimples used in the present invention the relative ratio of the diameters, d1/d2 of the dimples, or α, is greater than 0 and less than about 1, preferably is greater than or equal to 0.35 and less than or equal to 0.95 and more preferably is greater than or equal to 0.40 and less than or equal to 0.70.

Again referring to FIG. 21, the total depth of the dimple, ht, is the sum of the depth of the lower region of the dimple ($h_1$) as bordered by the bottom wall portion, 52*a*, and the depth of the upper region of the dimple ($h_2$) as bordered by the upper wall portion, 52*b*, Other parameters which must be considered when selecting dimples and the dimple patterns used in the golf balls of the present invention include both the total number of dimples (Ni) employed as well as their total dimple volume ("TDV") and the total surface area coverage (COV) of the dimples placed on the surface of the golf balls of the present invention.

The total number of dimples (Ni) employed on the golf balls of the present invention comprise of from about 250 to about 500, preferably of from 275 to about 475, and even more preferably of from about 300 to about 450 reduced equivalent depth dimples. Preferably the dimples comprise dual radius dimples.

The total volume of the dimples (TDV) employed on the golf balls of the present invention is calculated using the following formula, $$TDV = \sum_{i=1}^{n} Vi$$

where Vi is the total volume of dimple i

The total volume of the dimples (TDV) employed on the golf balls of the present invention is of from about 380 to about 425 $mm^3$, preferably of from about 385 to about 415 $mm^3$, more preferably of from about 380 to about 405 $mm^3$. For golf balls which have reduced distance at high headspeed but maintain distance at lower headspeed the TDV is of from about 380 to about 500 $mm^3$, preferably of from about 380 to about 475 $mm^3$, more preferably of from about 380 to about 460 $mm^3$.

The total percentage surface area coverage (COV) of the dimples placed on the surface of the golf balls of the present invention is calculated using the following formula, $$COV = 100 * \sum_{i=1}^{n} \pi(d_i^2/4)/A_o$$

Where di is the outer diameter of the dimple and $A_o$ is the surface area of a golf ball surface formed by the continuation of the land area surface if the dimples where removed (where the land area is the surface of the ball lying between the dimples). For the golf balls of the present invention $A_o$ has a value of 5720 $mm^2$ and COV is greater than about 65%, more preferably greater than about 70%, and even more preferably greater than about 75%.

Golf Ball Materials and Methods of Construction.

Golf balls are typically produced by pressing together two hemispherical mold halves that form a dimple pattern in a suitable material, such as a synthetic resin or other material, contained in the mold. In conventional approaches, the resulting golf ball may have a line formed on the ball called a parting line or seam which is the line formed by the coming together of the hemispherical mold halves during the molding process. In some cases, the dimples are separated slightly to make room for the parting line, which results in a perceptible parting line between the halves of the ball, which is coincident with the golf ball equator. In other cases, the mold halves are manufactured such the mating surfaces interlock to varying degrees when coming together such that the parting line or seam is more closely associated with the curvature of the dimples in close proximity the parting line and thus the parting line may in some cases straddle the equator of the golf ball at various points. This renders the parting line or seam less noticeable and thus are often referred to as "seamless" dimple patterns as compared the more convention patterns with a more noticeable seam. Attempts to configure the parting line to minimize visibility and its effect on the dimple pattern are described in U.S. Pat. No. 9,511,524 to R. Stefan having an issue date of Dec. 6, 2016, the entire contents of which are incorporated by reference herein.

The golf balls of the present invention are not limited to the type of parting line configuration selected and include both the conventional type of seam as well any of the so-called seamless dimple parting lines.

However, the generation of the dimple pattern as occurs during the molding process of the outer cover layer of the golf balls of the present invention provides another constraint on how shallow a dimple may be used. The golf ball seam is formed when the two halves of a golf ball mold come together in the molding process at the mold parting line, some seepage or flash of the molten polymer used for the outer cover in the vicinity of the golf ball parting occurs. On cooling and removal of the golf ball from the mold this polymer seepage or flash tends to stay with the ball and must be removed by an abrasive buffing procedure. Great care is required during the buffing process to avoid damaging the dimple edges.

Buffing problems for the so called "seamless" balls are more acute as the ball may have a parting line in a sinusoidal or saw tooth pattern or a combination of these and the like. The golf ball is then formed from a first hemispherical portion and a second hemispherical portion that are joined together at the mold parting line. This parting line may allow for the interdigitation of dimples across the equator. A more severe buffing problem for such "seamless" dimple patterns arises because of the dimples which are located so close to the parting line. Attempts to alleviate this problem may include the use of additional stock in the parting line vicinity and or chamfering the paring line to minimize the contact area.

For the golf balls with the dimple pattern of the present invention the problem is further alleviated by constraining the total depth (ht) of each dimple immediately adjacent to the parting line of the golf ball to be greater than about 0.145 mm, preferably greater than 0.150 mm, even more preferably greater than about 0.155 mm.

The golf balls of the present invention may comprise from 0 to at least 5 intermediate layer(s), preferably from 0 to 3 intermediate layer(s), more preferably from 1 to 3 intermediate layer(s), and most preferably 1 to 2 intermediate layer(s). FIGS. 25 and 26 illustrate a three piece and five piece golf ball construction respectively, Given the ubiquity of synthetic polymers and their wide range of properties it is not surprising that a large number of polymers along with their attendant stabilizing additive and filler packages are generally considered useful for making the components of the golf balls of the present invention including their core, intermediate layer(s) and outer cover layer. These include, without limitation the materials and attendant manufacturing methods described in U.S. Pat. No. 8,047,933, col 7 line 14 to column 22, line 6, the contents of which are herein incorporated by reference.

More specific examples of particular polymeric materials useful for making golf ball cores, optional intermediate layer(s) and outer covers, again without limitation, are provided below.

A most preferred polymeric material for the outer cover layer of the golf ball of the present invention is a polyurea or polyurethane, prepared by combining a diisocyanate with either a polyamine or polyol respectively, and one or more chain extenders (in the case of a thermoplastic polyurea or polyurethane) or curing agents (in the case of a thermoset polyurea or polyurethane) The final composition may advantageously be employed as an intermediate layer in a golf ball and even more advantageously as an outer cover layer.

The diisocyante and polyol or polyamine components may be previously combined to form a prepolymer prior to reaction with the chain extender or curing agent. Any such prepolymer combination is suitable for use in the present invention. Commercially available prepolymers include LFH580, LFH120, LFH710, LFH1570, LF930A, LF950A, LF601D, LF751D, LFG963A, LFG640D.

In the case of a thermoset polyurethane or polyurea, most preferred prepolymers are the polytetramethylene ether glycol terminated toluene diisocyanate prepolymers including those available from Uniroyal Chemical Company of Middlebury, Conn., under the trade name ADIPRENE® LF930A, LF950A, LF601D, and LF751D.

Preferably the curative may comprise a slow-reacting diamine or a fast-reacting diamine or any and all mixtures thereof. Such diamines include dimethylthio-2,4-toluenediamine sold under the trade name Ethacure® 300 and diethyl-2,4-toluenediamine sold under the trade name Ethacure® 100 both by Albermarle Corporation, Other curatives or additional additives may be added to control the cure rate of the thermoset mixture including diols polyols and polymeric diols and polyols. On such diol is butane 1,4-diol, Because the polyureas or polyurethanes used to make the covers of such golf balls generally contain an aromatic component, e.g., aromatic diisocyanate, polyol, or polyamine, they are susceptible to discoloration upon exposure to light, particularly ultraviolet (UV) light. To slow down the discoloration, light and UV stabilizers, e.g., TINUVIN® 770, 765, 571 and 328, are added to these aromatic polymeric materials. In addition, non-aromatic components may be used to minimize this discoloration, one example of which is described in U.S. Pat. No. 7,879,968, filed on May 31, 2007, the entire contents of which are hereby incorporated by reference.

The formulations and methods of making the thermoset polyurethane and polyurea used to form the outer cover layers of the golf balls of the present invention are more fully disclosed in U.S. Pat. No. 6,793,864 issuing on Sep. 21, 2004, the entire contents of which are incorporated herein by reference.

The, outer cover and/or one or intermediate layers of the golf ball may also comprise one or more ionomer resins. One family of such resins was developed in the mid-1960's, by E.I. DuPont de Nemours and Co., and sold under the trademark SURLYN®. Preparation of such ionomers is well known, for example see U.S. Pat. No. 3,264,272. Generally speaking, most commercial ionomers are unimodal and consist of a polymer of a mono-olefin, e.g., an alkene, with an unsaturated mono- or dicarboxylic acids having 3 to 12 carbon atoms. An additional monomer in the form of a mono- or dicarboxylic acid ester may also be incorporated in the formulation as a so-called "softening comonomer." The incorporated carboxylic acid groups are then neutralized by a basic metal ion salt, to form the ionomer. The metal cations of the basic metal ion salt used for neutralization include $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$, with the $Li^+$, $Na^+$, $Ca^{2+}$, $Zn^{2+}$, and $Mg^{2+}$ being preferred. The basic metal ion salts include those of for example formic acid, acetic acid, nitric acid, and carbonic acid, hydrogen carbonate salts, oxides, hydroxides, and alkoxides.

The first commercially available ionomer resins contained up to 16 weight percent acrylic or methacrylic acid, although it was also well known at that time that, as a general rule, the hardness of these cover materials could be increased with increasing acid content. Hence, in Research Disclosure 29703, published in January 1989, DuPont disclosed ionomers based on ethylene/acrylic acid or ethylene/methacrylic acid containing acid contents of greater than 15 weight percent. In this same disclosure, DuPont also taught that such so called "high acid ionomers" had significantly improved stiffness and hardness and thus could be advantageously used in golf ball construction, when used either singly or in a blend with other ionomers.

More recently, high acid ionomers can be ionomer resins with acrylic or methacrylic acid units present from 16 wt. % to about 35 wt. % in the polymer. Generally, such a high acid ionomer will have a flexural modulus from about 50,000 psi to about 125,000 psi.

Ionomer resins further comprising a softening comonomer, present from about 10 wt. % to about 50 wt. % in the polymer, have a flexural modulus from about 2,000 psi to about 10,000 psi, and are sometimes referred to as "soft" or "very low modulus" ionomers. Typical softening comonomers include n-butyl acrylate, iso-butyl acrylate, n-butyl methacrylate, methyl acrylate and methyl methacrylate.

Today, there are a wide variety of commercially available ionomer resins based both on copolymers of ethylene and (meth)acrylic acid or terpolymers of ethylene and (meth) acrylic acid and (meth)acrylate, all of which many of which are be used as a golf ball component. The properties of these ionomer resins can vary widely due to variations in acid content, softening comonomer content, the degree of neutralization, and the type of metal ion used in the neutralization. The full range commercially available typically includes ionomers of polymers of general formula, E/X/Y polymer, wherein E is ethylene, X is a $C_3$ to $C_8$ α,β-ethylenically unsaturated carboxylic acid, such as acrylic or methacrylic acid, and is present in an amount from about 2 to about 30 weight % of the E/X/Y copolymer, and Y is a softening comonomer selected from the group consisting of alkyl acrylate and alkyl methacrylate, such as methyl acrylate or methyl methacrylate, and wherein the alkyl groups have from 1-8 carbon atoms, Y is in the range of 0 to about 50 weight % of the E/X/Y copolymer, and wherein the acid groups present in said ionomeric polymer are partially neutralized with a metal selected from the group consisting of lithium, sodium, potassium, magnesium, calcium, barium, lead, tin, zinc or aluminum, and combinations thereof.

The ionomer may also be a so-called bimodal ionomer as described in U.S. Pat. No. 6,562,906 (the entire contents of which are herein incorporated by reference). These ionomers are bimodal as they are prepared from blends comprising polymers of different molecular weights. Specifically they include bimodal polymer blend compositions comprising: a) a high molecular weight component having molecular weight of about 80,000 to about 500,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said high molecular weight component being partially neutralized with metal ions selected from the group consisting of lithium, sodium, zinc, calcium, magnesium, and a mixture of any these; and b) a low molecular weight component having a molecular weight of about from about 2,000 to about 30,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said low molecular weight component being partially neutralized with metal ions selected from the group consisting of lithium, sodium, potassium, magnesium, calcium, barium, lead, tin, zinc or aluminum, and a mixture of any these.

In addition to the unimodal and bimodal ionomers, also included are the so-called "modified ionomers" examples of which are described in U.S. Pat. Nos. 6,100,321, 6,329,458 and 6,616,552, the entire contents of all of which are herein incorporated by reference.

The modified unimodal ionomers may be prepared by mixing: a) an ionomeric polymer comprising ethylene, from 5 to 25 weight percent (meth)acrylic acid, and from 0 to 40 weight percent of a (meth)acrylate monomer, said ionomeric polymer neutralized with metal ions selected from the group consisting of lithium, sodium, potassium, magnesium, calcium, barium, lead, tin, zinc or aluminum, and any and all mixtures thereof; and b) from about 5 to about 40 weight percent (based on the total weight of said modified ionomeric polymer) of one or more fatty acids or metal salts of said fatty acid, the metal selected from the group consisting of lithium, sodium, potassium, magnesium, calcium, barium, lead, tin, zinc or aluminum, and any and all mixtures thereof; and the fatty acid preferably being stearic acid.

The modified bimodal ionomers, which are ionomers derived from the earlier described bimodal ethylene/carboxylic acid polymers (as described in U.S. Pat. No. 6,562,906, the entire contents of which are herein incorporated by reference), are prepared by mixing; a) a high molecular weight component having molecular weight of about 80,000 to about 500,000 and comprising one or more ethylene/α,β-ethylenically unsaturated $C_{3-8}$ carboxylic acid copolymers and/or one or more ethylene, alkyl (meth)acrylate, (meth) acrylic acid terpolymers; said high molecular weight component being partially neutralized with metal ions selected from the group consisting of lithium, sodium, potassium, magnesium, calcium, barium, lead, tin, zinc or aluminum, and any and all mixtures thereof; and b) a low molecular weight component having a molecular weight of about from about 2,000 to about 30,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said low molecular weight component being partially neutralized with metal ions selected from the group consisting of lithium, sodium, potassium, magnesium, calcium, barium, lead, tin, zinc or aluminum, and any and all mixtures thereof; and c) from about 5 to about 40 weight percent (based on the total weight of said modified ionomeric polymer) of one or more fatty acids or metal salts of said fatty acid, the metal selected from the group consisting of lithium, sodium, potassium, magnesium, calcium, barium, lead, tin, zinc or aluminum, and any and all mixtures thereof; and the fatty acid preferably being stearic acid.

More specifically, the fatty or waxy acid salts utilized in the various modified ionomers are composed of a chain of alkyl groups containing from about 4 to 75 carbon atoms (usually even numbered) and characterized by a —COOH terminal group. The generic formula for all fatty and waxy acids above acetic acid is $CH_3(CH_2)_xCOOH$, wherein the carbon atom count includes the carboxyl group (i.e. x=2-73). The fatty or waxy acids utilized to produce the fatty or waxy acid salts modifiers may be saturated or unsaturated, and they may be present in solid, semi-solid or liquid form.

Examples of suitable saturated fatty acids, i.e., fatty acids in which the carbon atoms of the alkyl chain are connected by single bonds, include but are not limited to stearic acid ($CH_3(CH_2)_{16}COOH$), palmitic acid ($CH_3(CH_2)_{14}COOH$), pelargonic acid ($CH_3(CH_2)_7COOH$) and lauric acid ($CH_3(CH_2)_{10}COOH$). Examples of suitable unsaturated fatty acids, i.e., a fatty acid in which there are one or more double bonds between the carbon atoms in the alkyl chain, include but are not limited to oleic acid ($CH_3(CH_2)_7CH{:}CH(CH_2)_7COOH$).

The source of the metal ions used to produce the metal salts of the fatty or waxy acid salts used in the various modified ionomers are generally various metal salts which provide the metal ions capable of neutralizing, to various extents, the carboxylic acid groups of the fatty acids. These include the sulfate, carbonate, acetate and hydroxylate salts of zinc, barium, calcium and magnesium.

Since the fatty acid salts modifiers comprise various combinations of fatty acids neutralized with a large number of different metal ions, several different types of fatty acid salts may be utilized in the invention, including metal stearates, laureates, oleates, and palmitates, with calcium, zinc, sodium, lithium, potassium and magnesium stearate being preferred, and calcium and sodium stearate being most preferred.

The fatty or waxy acid or metal salt of said fatty or waxy acid is present in the modified ionomeric polymers in an amount of from about 5 to about 40, preferably from about 7 to about 35, more preferably from about 8 to about 20 weight percent (based on the total weight of said modified ionomeric polymer).

As a result of the addition of the one or more metal salts of a fatty or waxy acid, from about 40 to 100, preferably from about 50 to 100, more preferably from about 70 to 100 percent of the acidic groups in the final modified ionomeric polymer composition are neutralized by a metal ion. Suitable modified ionomer polymers contemplated for use with the present invention include, but are not limited to, the ENTIRA® family of polymers including ENTIRA 8218 commercially available from Dow Chemical and Dupont® HPF 1000, Dupont® HPF 1035, Dupont® HPF AD 1072, Dupont® HPF 2000, Dupont® HPC AD 1043, and Dupont®HPC AD 1022, all commercially available from E.I. du Pont de Nemours and Company.

A preferred ionomer composition may be prepared by blending one or more of the unimodal ionomers, bimodal ionomers, or modified unimodal or bimodal ionomeric polymers as described herein, and further blended with a zinc neutralized ionomer of a polymer of general formula E/X/Y where E is ethylene, X is a softening comonomer such as acrylate or methacrylate and is present in an amount of from 0 to about 50, preferably 0 to about 25, most preferably 0, and Y is acrylic or methacrylic acid and is present in an amount from about 5 wt. % to about 25, preferably from about 10 to about 25, and most preferably about 10 to about 20 wt % of the total composition.

Golf balls materials within the scope of the present invention also can include, in suitable amounts, one or more additional ingredients generally employed in plastics formulation or the preparation of golf ball compositions. Conventional additives such as plasticizers, pigments, antioxidants, U.V. absorbers, optical brighteners, or any other additives may generally employed.

Agents provided to achieve specific functions, such as additives and stabilizers, can be present. Exemplary suitable ingredients include colorants, antioxidants, colorants, dispersants, mold releasing agents, processing aids, fillers, and any and all combinations thereof. Although not required, UV stabilizers, or photo stabilizers such as substituted hydroxphenyl benzotriazoles may be utilized in the present invention to enhance the UV stability of the final compositions. An example of a commercially available UV stabilizer is the stabilizer sold by Ciba Geigy Corporation under the tradename TINUVIN®.

Typically, the various golf ball intermediate layer and/or cover formulations compositions are made by mixing together the various components and other additives with or without melting them. Dry blending equipment, such as a tumble mixer, V-blender, ribbon blender, or two-roll mill, can be used to mix the compositions. The golf ball compositions can also be mixed using a mill, internal mixer such as a Banbury or Farrel continuous mixer, extruder or combinations of these, with or without application of thermal energy to produce melting.

The cores of the golf balls of the present invention may include the traditional rubber components used in golf ball applications including, both natural and synthetic rubbers, such as cis-1,4-polybutadiene, trans-1,4-polybutadiene, 1,2-polybutadiene, cis-polyisoprene, trans-polyisoprene, polyalkenamers, polychloroprene, polybutylene, styrene-butadiene rubber, styrene-butadiene-styrene block copolymer and partially and fully hydrogenated equivalents, styrene-isoprene-styrene block copolymer and partially and fully hydrogenated equivalents, nitrile rubber, silicone rubber, and polyurethane, as well as mixtures of these. Polybutadiene rubbers, especially 1,4-polybutadiene rubbers containing at least 40 mol %, and more preferably 80 to 100 mol % of cis-1,4 bonds, are preferred because of their high rebound resilience, moldability, and high strength after vulcanization. The polybutadiene component may be synthesized by using rare earth-based catalysts, nickel-based catalysts, or cobalt-based catalysts, conventionally used in this field. Polybutadiene obtained by using lanthanum rare earth-based catalysts usually employ a combination of a lanthanum rare earth (atomic number of 57 to 71)-compound, but particularly preferred is a neodymium compound.

When synthetic rubbers such as the aforementioned polybutadienes and/or its blends are used in the golf balls of the present invention they may contain further materials typically often used in rubber formulations including crosslinking agents, co-crosslinking agents, peptizers and accelerators.

Suitable cross-linking agents for use in the golf balls of the present invention include peroxides, sulfur compounds, or other known chemical cross-linking agents, as well as mixtures of these. Non-limiting examples of suitable cross-linking agents include primary, secondary, or tertiary aliphatic or aromatic organic peroxides such as Trigonox® 145-45B, marketed by Akrochem Corp. of Akron, Ohio; 1,1-bis(t-butylperoxy)-3,3,5 tri-methylcyclohexane, such as Varox® 231-XL, marketed by R.T. Vanderbilt Co., Inc. of Norwalk, Conn.; and di-(2,4-dichlorobenzoyl)peroxide.

Besides the use of chemical cross-linking agents, exposure of the composition to radiation also can serve as a cross-linking agent. Radiation can be applied to the unsaturated polymer mixture by any known method, including using microwave or gamma radiation, or an electron beam device. Additives may also be used to improve radiation curing of the diene polymer.

The rubber and cross-linking agent may be blended with a co-cross-linking agent, which may be a metal salt of an unsaturated carboxylic acid. Examples of these include zinc and magnesium salts of unsaturated fatty acids having 3 to 8 carbon atoms, such as acrylic acid, methacrylic acid, maleic acid, and fumaric acid, palmitic acid with the zinc salts of acrylic and methacrylic acid being most preferred. The core compositions used in the present invention may also incorporate one or more of the so-called "peptizers".

The peptizer preferably comprises an organic sulfur compound and/or its metal or non-metal salt. Examples of such organic sulfur compounds include thiophenols, such as pentachlorothiophenol, 4-butyl-o-thiocresol, 4 t-butyl-p-thiocresol, and 2-benzamidothiophenol; thiocarboxylic acids, such as thiobenzoic acid; 4,4' dithio dimorpholine; and, sulfides, such as dixylyl disulfide, dibenzoyl disulfide; dibenzothiazyl disulfide; di(pentachlorophenyl)disulfide; dibenzamido diphenyldisulfide (DBDD), and alkylated phenol sulfides, such as VULTAC® marketed by Atofina Chemicals, Inc. of Philadelphia, Pa. Preferred organic sulfur compounds include pentachlorothiophenol, and dibenzamido diphenyldisulfide.

Examples of the metal salt of an organic sulfur compound include sodium, potassium, lithium, magnesium calcium, barium, cesium and zinc salts of the above-mentioned thiophenols and thiocarboxylic acids, with the zinc salt of pentachlorothiophenol being most preferred.

Examples of the non-metal salt of an organic sulfur compound include ammonium salts of the above-mentioned thiophenols and thiocarboxylic acids wherein the ammonium cation has the general formula $[NR_1R_2R_3R_4]^+$ where $R_1$ $R_2$ $R_3$ and $R_4$ are selected from the group consisting of hydrogen, a $C_1$-$C_2$o aliphatic, cycloaliphatic or aromatic moiety, and any and all combinations thereof, with the most preferred being the $NH_4^+$-salt of pentachlorothiophenol.

Additional peptizers include aromatic or conjugated peptizers comprising one or more heteroatoms, such as nitrogen, oxygen and/or sulfur. More typically, such peptizers are heteroaryl or heterocyclic compounds having at least one heteroatom, and potentially plural heteroatoms, where the plural heteroatoms may be the same or different. Such peptizers include peptizers such as an indole peptizer, a quinoline peptizer, an isoquinoline peptizer, a pyridine peptizer, purine peptizer, a pyrimidine peptizer, a diazine peptizer, a pyrazine peptizer, a triazine peptizer, a carbazole peptizer, or combinations of such peptizers. A most preferred such peptizer is a tetrachloro-pyridinethiol and most preferably 2,3,5,6-tetrachloro-4-pyridinethiol.

Such peptizers are more fully disclosed in U.S. Pat. No. 8,912,286 issuing on Dec. 16, 2014, the entire contents of which are herein incorporated by reference.

The core component polymer(s), crosslinking agent(s), filler(s) and the like can be mixed together with or without melting them. In one method of manufacture the cross-linking agents and other components can be added to the unsaturated polymer as part of a concentrate using dry blending, roll milling, or melt mixing. The various core components can be mixed together with the cross-linking agents, or each additive can be added in an appropriate sequence to the milled unsaturated polymer. The resulting mixture can be subjected to, for example, a compression or injection molding process, to obtain solid spheres for the core. The polymer mixture is subjected to a molding cycle in which heat, and pressure are applied while the mixture is confined within a mold. The cavity shape depends on the portion of the golf ball being formed. The compression and heat liberate free radicals by decomposing one or more peroxides, which initiate cross-linking. The temperature and duration of the molding cycle are selected based upon the type of peroxide and peptizer selected. The molding cycle may have a single step of molding the mixture at a single temperature for fixed time duration.

After core formation, the golf ball cover and any mantle layers are typically positioned over the core using one of three methods: casting, injection molding, or compression molding.

Injection molding generally involves using a mold having one or more sets of two hemispherical mold sections that mate to form a spherical cavity during the molding process. The pairs of mold sections are configured to define a spherical cavity in their interior when mated. When used to mold an outer cover layer for a golf ball, the mold sections can be configured so that the inner surfaces that mate to form the spherical cavity include protrusions configured to form dimples on the outer surface of the molded cover layer. When used to mold an intermediate layer(s) onto an existing structure, such as a ball core, the mold includes a number of support pins disposed throughout the mold sections. The support pins are configured to be retractable, moving into and out of the cavity perpendicular to the spherical cavity surface. The support pins maintain the position of the core while the molten material flows through the gates into the cavity between the core and the mold sections. The mold itself may be a cold mold or a heated mold Compression molding of a ball outer cover or intermediate layer(s) may also utilize the initial step of making half shells by injection molding the layer material into an injection mold. The half shells then are positioned in a compression mold around a ball core, whereupon heat and pressure are used to mold the half shells into a complete layer over the core, with or without a chemical reaction such as crosslinking Compression molding also can be used as a curing step after injection molding. In such a process, an outer layer of thermally curable material is injection molded around a core in a cold mold. After the material solidifies, the ball is removed and placed into a mold, in which heat, and pressure are applied to the ball to induce curing in the outer layer.

Covers may also be formed around the cores using compression molding. Cover materials for compression molding may also be extruded or blended resins or castable resins.

In the case of outer cover layers made from a thermoset polyurethane or polyurea composition for golf balls of the present invention a most preferred method is that of casting.

Casting (also called "cast-molding") is performed in a ball cavity formed by bringing together two mold halves that define respective hemispherical cavities. Casting is especially suitable when forming the outer cover layer of a thermoset material, including the thermoset polyurethane or polyurea formulations used in the golf balls of the present invention. In the casting process, a precise amount of liquid thermoset resin is introduced into a first mold cavity of a given pair of mold half shells and allowed to partially cure ("gel"). The core or preformed core with any intermediate layers is placed in the hemispherical cavity of one mold half and supported by the partially cured resin. Once the castable composition is at least partially cured (e.g., to a point where the core will not substantially move), additional castable composition is introduced into a second mold cavity of each pair, and the mold is closed. As the mold halves are brought together, the resin flows around the core and forms the cover. The closed mold is then subjected to heat and pressure to cure the composition, thereby forming the outer layer about the core. The mold is then cooled for removal of the ball from the mold body. The mold cavities include a negative of the dimple pattern of the present invention to impart the dimples onto the outer cover layer. A more complete description of cast molding a thermoset polyurethane or polyurea outer cover on a preformed golf ball core having one or more intermediate layers is disclosed in U.S. Pat. No. 5,885,172 issuing on Mar. 23, 1999, the entire contents of which are incorporated by reference herein.

More generally, the intermediate layers of the golf balls of the present invention have a thickness of about 0.01 to about 0.50, preferably from about 0.02 to about 0.30 or more preferably from about 0.03 to about 0.20 or most preferably from about 0.02 to about 0.10 in.

More generally, the intermediate layers of the golf balls of the present invention also have a hardness greater than about 25 and less than about 85, preferably greater than about 30 and less than about 80, more preferably greater than about 35 and less than about 75, and most preferably greater than about 35 and less than about 70 Shore D units as measured on the ball.

More generally, the intermediate layers of the golf balls of the present invention also have a flexural modulus from about 5 to about 500, preferably from about 15 to about 400, more preferably from about 20 to about 300, still more preferably from about 25 to about 200, and most preferably from about 30 to about 150 kpsi.

More generally, one or more of the intermediate layers of the golf balls of the present invention also have a $COR_{125}$ from about 0.700 to about 0.860, preferably from about 0.710 to about 0.850, more preferably from about 0.720 to about 0.840 and may also be greater than about 0.810.

More specifically in the case of a ball with one or more intermediate layers, the innermost intermediate layer (i.e. the one directly adjacent to the core) will have a $COR_{125}$ from about 0.700 to about 0.820, preferably from about 0.720 to about 0.810, the outermost intermediate layer (i.e. the one directly adjacent to the outer cover layer) will have a $COR_{125}$ from about 0.730 to about 0.860, preferably from about 0.780 to about 0.850, and any intermediate layers between the innermost and outermost intermediate layers will have a $COR_{125}$ from about 0.710 to about 0.830, preferably from about 0.730 to about 0.820 More generally, the outer cover layer of the golf balls of the present invention have a thickness of about 0.010 to about 0.08, preferably from about 0.015 to about 0.06, and more preferably from about 0.020 to about 0.040 in.

More generally, the outer cover layer of the golf balls of the present invention also has a hardness from about 40 to about 70, preferably from about 45 to about 70 or about 50 to about 70, more preferably from 47 to about 68 or about 45 to about 70, and most preferably from about 50 to about 65 Shore D as measured on the ball.

The PGA compression of the golf balls of the present invention is less than or equal to 114 PGA, more preferably less than or equal to 80 PGA even more preferably less than or equal to 65 PGA.

More specifically the PGA compression of the golf balls of the present invention is from about −10 to about 114, more preferably from about 20 to about 70 PGA.

The PGA compression of the cores of the golf balls of the present invention is less than or equal 80 PGA preferably less than or equal to 65 PGA more preferably less than or equal to 50 PGA and even more preferably less than or equal to 35 PGA. More specifically the PGA compression of the cores of the golf balls of the present invention is from about −20 to about 60, more preferably from about −10 to about 40 PGA.

The cores of the golf balls of the present invention have a $COR_{125}$ from about 0.700 to about 0.860, preferably from about 0.710 to about 0.850, more preferably from about 0.720 to about 0.840 and may also be greater than about 0.810.

More generally, the core of the golf balls of the present invention is a unitary core with little or no difference between the hardness of the core measured at its center and the hardness as measured at its outer surface ie no such appreciable core hardness gradient.

However, the core of the golf balls of the present invention may also comprise a center and one or more core layers disposed around the center. These core layers comprise the same rubber as used in the center portion. The various core layers (including the center) may each exhibit a different hardness. The difference between the center hardness and that of the next adjacent layer, as well as the difference in hardness between the various core layers is greater than 2, preferably greater than 5, most preferably greater than 10 units of Shore D.

In one preferred embodiment, the hardness of the center and each sequential layer increases progressively outwards from the center to outer core layer.

In another preferred embodiment, the hardness of the center and each sequential layer decreases progressively inwards from the outer core layer to the center.

Figure 22:
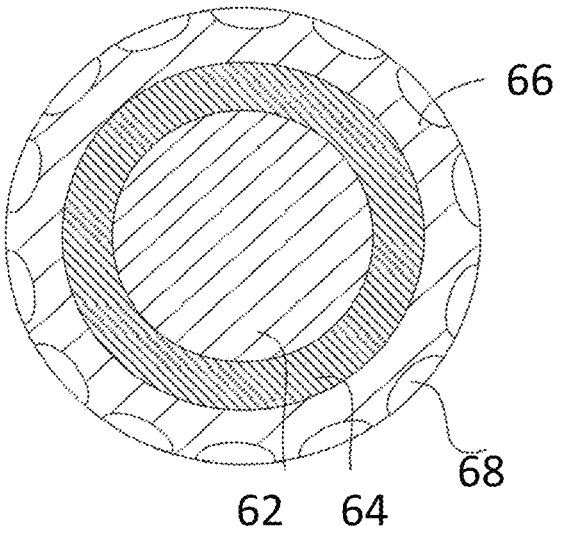
FIG. 22 illustrates a transverse cross section of a 3 piece golf ball 60 comprising a core 62, an intermediate layer 64 and an outer cover layer 66. Golf ball 60 also typically includes plural dimples 68 formed in the outer cover layer 66 (dimples 68 are not to scale, and FIG. 25 does not illustrate the presently disclosed dimple pattern).

Referring to the drawing in FIG. 22, there is illustrated a transverse cross section of a 3 piece golf ball 60 comprising a core 62, an intermediate layer 64 and an outer cover layer 66. Golf ball 60 also typically includes plural dimples 68 formed in the outer cover layer 66 and arranged in various desired patterns (dimples 68 are not to scale, and FIG. 22 does not illustrate the presently disclosed dimple pattern).

More specifically, the intermediate layer of the three piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The intermediate layer of the three piece golf balls of the present invention also has a hardness of from about 25 to about 80, more preferably of from about 30 to about 70, even more preferably of from about 40 to about 60 Shore D The outer cover layer of the three piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The outer cover layer of the three piece golf balls of the present invention also has a hardness of from about 25 to about 80, more preferably from about 30 to about 70, even more preferably from about 40 to about 60 Shore D.

The core of the three piece golf balls of the present invention has a diameter of from about 0.5 to about 1.62, preferably from about 0.7 to about 1.60, more preferably from about 1 to about 1.58 inches.

The core of the three piece golf balls of the present invention has a PGA compression of from about 10 to about 100, preferably from about 35 to about 90, more preferably from about 40 to about 80.

The PGA compression of the cores of the three piece golf balls of the present invention is less than or equal 80 PGA preferably less than or equal to 65 PGA more preferably less than or equal to 50PGA and even more preferably less than or equal to 35 PGA.

The three-piece golf balls of the present invention has a PGA ball compression greater than about 30 and less than or equal to 114 PGA, preferably greater than 40, more preferably greater than about 50 less than or equal to 80 PGA, and most preferably greater than about 60 less than or equal to 65 PGA.

Figure 23:
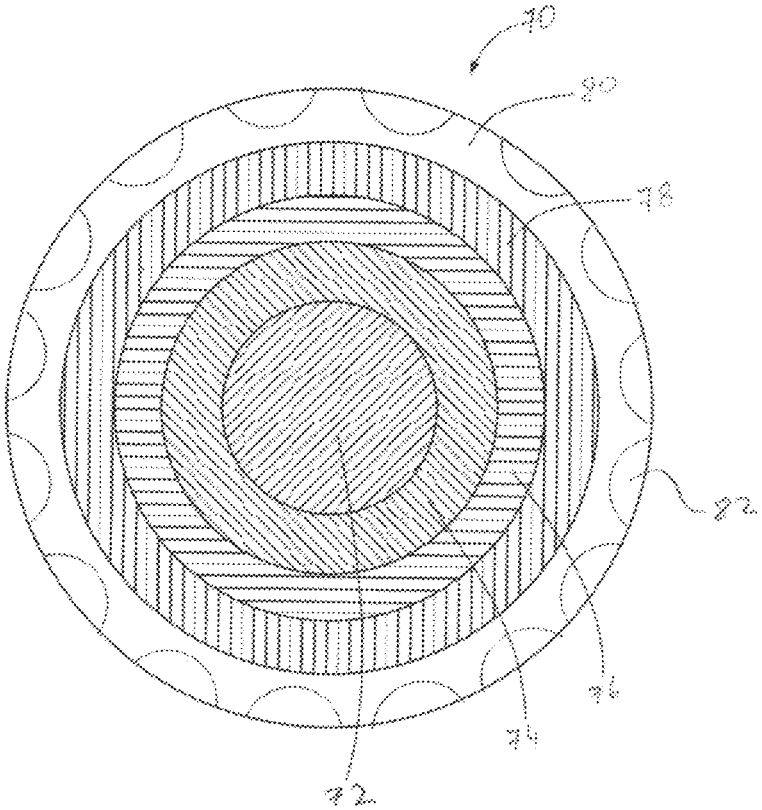
FIG. 23 illustrates a transverse cross section of a 5 piece golf ball 70 comprising a core 72, an inner intermediate layer 74, a center intermediate layer 76, an outer intermediate layer 78 and an outer cover layer 80. Golf ball 70 also typically includes plural dimples 82 formed in the outer cover layer 80 (dimples 82 are not to scale, and FIG. 23 does not illustrate the presently disclosed dimple pattern).

Referring to the drawing in FIG. 23 there is illustrated a transverse cross section of a 5 piece golf ball 70 comprising a core 72, an inner intermediate layer 74, a center intermediate layer 76, an outer intermediate layer 78 and an outer cover layer 80. Golf ball 70 also typically includes plural dimples 82 formed in the outer cover layer 80 and arranged in various desired patterns (dimples 82 are not to scale, and FIG. 23 does not illustrate the presently disclosed dimple pattern).

More specifically, the inner intermediate layer of the five piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The inner intermediate layer of the five piece golf balls of the present invention has a hardness of from about 25 to about 80, more preferably from about 30 to about 70, even more preferably from about 35 to about 60 Shore D.

The center intermediate layer of the five piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The center intermediate layer of the five piece golf balls of the present invention also has a hardness of from about 25 to about 80, more preferably from about 30 to about 70, even more preferably from about 40 to about 60 Shore D.

The outer intermediate layer of the five piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The outer intermediate layer of the five piece golf balls of the present invention also has a hardness of from about 25 to about 85, more preferably from about 30 to about 80, even more preferably from about 40 to about 75 Shore D.

The outer cover layer of the five piece golf balls of the present invention has a thickness of from about 0.01 to about 0.20 inch, preferably from about 0.02 to about 0.15 inch, more preferably from about 0.015 to about 0.10 inch and most preferably from about 0.02 to about 0.07 inches.

The outer cover layer of the five piece golf balls of the present invention also has a hardness of from about 25 to about 80, more preferably from about 30 to about 70, even more preferably from about 40 to about 60 Shore D.

The core of the five piece golf balls of the present invention has a diameter of from about 0.5 to about 1.62, preferably from about 0.7 to about 1.60, more preferably from about 1 to about 1.58 inches.

The core of the five piece golf balls of the present invention has a PGA compression of from about 10 to about 100, preferably from about 20 to about 90, more preferably from about 30 to about 80.

The PGA compression of the cores of the five piece golf balls of the present invention is less than or equal 80 PGA preferably less than or equal to 65 PGA more preferably less than or equal to 50 PGA and even more preferably less than or equal to 35 PGA.

The five piece golf balls of the present invention has a PGA ball compression greater than about 30 and less than or equal to 114 PGA, preferably greater than 40, more preferably greater than about 50 less than or equal to 80 PGA, and most preferably greater than about 60 less than or equal to 65 PGA.

The five-piece golf balls of the present invention have a PGA ball compression greater than about 30, preferably greater than 40, more preferably greater than about 50, most preferably greater than about 65.

The invention claimed is:

1. A golf ball having;

a core comprising a polybutadiene rubber, the core having a difference between a Shore D hardness measured at a center of the core and a Shore D hardness measured at a surface of the core of no greater than 2 Shore D units;

an innermost intermediate layer disposed directly over the core, the innermost intermediate layer comprising a bimodal ionomer neutralized to at least 90% with magnesium cations and having a thickness of from 0.04 to 0.06 inches and a Shore D hardness of from 45 to 50;

a center intermediate layer disposed over the innermost intermediate layer, the center intermediate layer comprising thermoplastic polyurethane and having a thickness of from 0.03 to 0.05 inches and a Shore D hardness of from 50 to 55;

an outer intermediate layer disposed over the center intermediate layer, the outer intermediate layer comprising a modified unimodal ionomer and having a thickness of from 0.03 to 0.07 inches and a Shore D hardness of from 55 to 60;

an outer cover layer disposed over the outer intermediate layer, the outer cover layer comprising thermoset polyurethane having a thickness of 0.022 inches and a Shore D hardness of 58, the outer cover layer having a dimple pattern comprising 375 dual-radius dimples, each dimple adjacent to a parting line having a depth of at least 0.155 mm, and wherein a dimple pattern of a southern hemisphere of the golf ball is rotated by 30 degrees relative to a dimple pattern of a northern hemisphere of the golf ball;

a contact time measured using an impact speed of 143 ft/s ($CT_{143}$) of greater than or equal to 400 microseconds;

a coefficient of restitution measured using an impact speed of 143 ft/s ($COR_{143}$) of greater than or equal to 0.720;

an initial velocity (IV) of greater than or equal to 255 ft/sec, calculated by an equation; and a relative ratio, $RR_{80/127}$ or $RR_{80/125}$ or $RR_{80/123}$ each greater than or equal to 1.01, where:

$RR_{80/127}=(TDC_{80}/HS_{80})/(TDC_{127}/HS_{127})$,wherein $TDC_{80}$ is the total distance calculated using a clubhead speed of 80 mph, $TDC_{127}$ is the total distance calculated using a clubhead speed at 127 mph, $HS_{80}$ is the clubhead speed at 80 mph, and $HS_{127}$ is the clubhead speed at 127 mph;

$RR_{80/125}=(TDC_{80}/HS_{80})/(TDC_{125}/HS_{125})$, wherein $TDC_{125}$ is the total distance calculated using a clubhead speed of 125 mph, and $HS_{125}$ is the clubhead speed at 125 mph;

$RR_{80/123}=(TDC_{80}/HS_{80})/(TDC_{123}/HS_{123})$, wherein $TDC_{123}$ is the total distance calculated using a clubhead speed at 123 mph, and $HS_{123}$ is the clubhead speed at 123 mph; or a relative ratio, $RR_{90/127}$ or $RR_{90/125}$ or $RR_{90/123}$ each greater than or equal to 1.03, where:

$RR_{90/127}=(TDC_{90}/HS_{90})/(TDC_{127}/HS_{127})$ wherein $TDC_{90}$ is the total distance calculated using a clubhead speed of 90 mph, $HS_{90}$ is the clubhead speed at 90 mph;

$RR_{90/125}=(TDC_{90}/HS_{90})/(TDC_{125}/HS_{125})$;

$RR_{90/123}=(TDC_{90}/HS_{90})/(TDC_{123}/HS_{123})$.

2. The golf ball of claim 1, wherein:

the $CT_{143}$ is greater than or equal to 550 microseconds;

the $COR_{143}$ is greater than or equal to 0.780; and the relative ratio, $RR_{80/127}$ or $RR_{80/125}$ or $RR_{80/123}$ are each greater than or equal to 1.03.

3. The golf ball of claim 1, wherein:

the $CT_{143}$ is greater than or equal to 650 microseconds;

the $COR_{143}$ is greater than or equal to 0.840;

the relative ratio, $RR_{80/127}$ or $RR_{80/125}$ or $RR_{80/123}$ are each greater than or equal to 1.05.

4. The golf ball of claim 1, wherein the golf ball has;

a compression of less than or equal to 114 PGA;

the core has;

i) a compression of less than about 50 PGA; and ii) a $COR_{125}$ of greater than or equal to 0.700; and one or more intermediate layers having a $COR_{125}$ of greater than about 0.810.

5. A golf ball having;

a core comprising a polybutadiene rubber, the core having a difference between a Shore D hardness measured at a center of the core and a Shore D hardness measured at a surface of the core of no greater than 2 Shore D units;

an innermost intermediate layer disposed directly over the core, the innermost intermediate layer comprising a bimodal ionomer neutralized to at least 90% with magnesium cations and having a thickness of from 0.04 to 0.06 inches and a Shore D hardness of from 45 to 50;

a center intermediate layer disposed over the innermost intermediate layer, the center intermediate layer comprising thermoplastic polyurethane and having a thickness of from 0.03 to 0.05 inches and a Shore D hardness of from 50 to 55;

an outer intermediate layer disposed over the center intermediate layer, the outer intermediate layer comprising a modified unimodal ionomer and having a thickness of from 0.03 to 0.07 inches and a Shore D hardness of from 55 to 60;

an outer cover layer disposed over the outer intermediate layer, the outer cover layer comprising thermoset polyurethane having a thickness of 0.022 inches and a Shore D hardness of 58, the outer cover layer having a dimple pattern comprising 375 dual-radius dimples, each dimple adjacent to a parting line having a depth of at least 0.155 mm, and wherein a dimple pattern of a southern hemisphere of the golf ball is rotated by 30 degrees relative to a dimple pattern of a northern hemisphere of the golf ball;

a contact time measured using an impact speed of 143 ft/s ($CT_{143}$) of greater than or equal to 400 microseconds;

a coefficient of restitution measured using an impact speed of 143 ft/s ($COR_{143}$) of greater than about 0.780;

a relative ratio, $RR_{80/127}$ or $RR_{80/125}$ or $RR_{80/123}$ each greater than or equal to 1.01, where:

$RR_{80/127}=(TDC_{80}/HS_{80})/(TDC_{127}/HS_{127})$,wherein $TDC_{80}$ is the total distance calculated using a clubhead speed of 80 mph, $TDC_{127}$ is the total distance calculated using a clubhead speed of 127 mph, $HS_{80}$ is the clubhead speed of 80 mph, and $HS_{127}$ is the clubhead speed of 127 mph;

$RR_{80/125}=(TDC_{80}/HS_{80})/(TDC_{125}/HS_{125})$, wherein $TDC_{125}$ is the total distance calculated using a clubhead speed of 125 mph, and $HS_{125}$ is the clubhead speed of 125 mph;

$RR_{80/123}=(TDC_{80}/HS_{80})/(TDC_{123}/HS_{123})$, wherein $TDC_{123}$ is the total distance calculated using a clubhead speed of 123 mph, and $HS_{123}$ is the clubhead speed of 123 mph; or a relative ratio, $RR_{90/127}$ or $RR_{90/125}$ or $RR_{90/123}$ each greater than or equal to 1.03, where:

$RR_{90/127}=(TDC_{90}/HS_{90})/(TDC_{127}/HS_{127})$ wherein $TDC_{90}$ is the total distance calculated using a clubhead speed of 90 mph, and $HS_{90}$ is the clubhead speed of 90 mph;

$RR_{90/125}=(TDC_{90}/HS_{90})/(TDC_{125}/HS_{125})$;

$RR_{90/123}=(TDC_{90}/HS_{90})/(TDC_{123}/HS_{123})$.

6. The golf ball of claim 5, wherein:

the $CT_{143}$ is greater than or equal to 550 microseconds;

the $COR_{143}$ is greater than or equal to 0.780; and the relative ratio, $RR_{80/127}$ or $RR_{80/125}$ or $RR_{80/123}$ each greater than or equal to 1.03.

7. The golf ball of claim 5, wherein:

the $CT_{143}$ is greater than or equal to 650 microseconds;

the $COR_{143}$ is greater than or equal to 0.840; and the relative ratio, $RR_{80/127}$ or $RR_{80/125}$ or $RR_{80/123}$ each greater than or equal to 1.05.

8. The golf ball of claim 5, wherein the golf ball has;

a compression of less than or equal to 114 PGA;

the core has;

i) a compression of less than about 50 PGA; and ii) a $COR_{125}$ of greater than or equal to 0.700; and one or more intermediate layers having a $COR_{125}$ of greater than about 0.810.

9. A golf ball having;

a core comprising a polybutadiene rubber, the core having a difference between a Shore D hardness measured at a center of the core and a Shore D hardness measured at a surface of the core of no greater than 2 Shore D units;

an innermost intermediate layer disposed directly over the core, the innermost intermediate layer comprising a bimodal ionomer neutralized to at least 90% with magnesium cations and having a thickness of from 0.04 to 0.06 inches and a Shore D hardness of from 45 to 50;

a center intermediate layer disposed over the innermost intermediate layer, the center intermediate layer comprising thermoplastic polyurethane and having a thickness of from 0.03 to 0.05 inches and a Shore D hardness of from 50 to 55;

an outer intermediate layer disposed over the center intermediate layer, the outer intermediate layer comprising a modified unimodal ionomer and having a thickness of from 0.03 to 0.07 inches and a Shore D hardness of from 55 to 60;

an outer cover layer disposed over the outer intermediate layer, the outer cover layer comprising thermoset polyurethane having a thickness of 0.022 inches and a Shore D hardness of 58, the outer cover layer having a dimple pattern comprising 375 dual-radius dimples, each dimple adjacent to a parting line having a depth of at least 0.155 mm, and wherein a dimple pattern of a southern hemisphere of the golf ball is rotated by 30 degrees relative to a dimple pattern of a northern hemisphere of the golf ball;

a contact time measured using an impact speed of 143 ft/s ($CT_{143}$) of greater than or equal to 400 microseconds;

a coefficient of restitution measured using at an impact speed of 143 ft/s ($COR_{143}$) of greater than or equal to 0.790; and a relative ratio, $RR_{80/127}$ or $RR_{80/125}$ or $RR_{80/123}$ each greater than or equal to 1.02, where:

$RR_{80/127}=(TDC_{80}/HS_{80})/(TDC_{127}/HS_{127})$,wherein $TDC_{80}$ is the total distance calculated using a clubhead speed of 80 mph, $TDC_{127}$ is the total distance calculated using a clubhead speed at 127 mph, $HS_{80}$ is the clubhead speed of 80 mph, and $HS_{127}$ is the clubhead speed of 127 mph;

$RR_{80/125}=(TDC_{80}/HS_{80})/(TDC_{125}/HS_{125})$, wherein $TDC_{125}$ is the total distance calculated using a clubhead speed of 125 mph, and $HS_{125}$ is the clubhead speed of 125 mph;

$RR_{80/123}=(TDC_{80}/HS_{80})/(TDC_{123}/HS_{123})$, wherein $TDC_{123}$ is the total distance calculated using a clubhead speed at 123 mph, and $HS_1$s is the clubhead speed of 123 mph.

* * * * *